US008186969B2

(12) United States Patent
Morita et al.

(10) Patent No.: US 8,186,969 B2
(45) Date of Patent: May 29, 2012

(54) VARIABLE DISPLACEMENT PUMP

(75) Inventors: Shoji Morita, Aiko-gun (JP); Yasushi Watanabe, Aiko-gun (JP); Koji Saga, Ebina (JP)

(73) Assignee: Hitachi, Ltd., Tokyo (JP)

( * ) Notice: Subject to any disclaimer, the term of this patent is extended or adjusted under 35 U.S.C. 154(b) by 993 days.

(21) Appl. No.: 12/136,796

(22) Filed: Jun. 11, 2008

(65) Prior Publication Data

US 2008/0308062 A1 Dec. 18, 2008

(30) Foreign Application Priority Data

Jun. 14, 2007 (JP) ..... 2007-157000

(51) Int. Cl.
*F04B 49/00* (2006.01)

(52) U.S. Cl. ..... 417/220; 417/219; 417/213; 418/26; 418/27; 418/30

(58) Field of Classification Search ..... 417/213, 417/220, 274, 295, 219, 221; 418/24, 26–30
See application file for complete search history.

(56) References Cited

U.S. PATENT DOCUMENTS

| | | | | |
|---|---|---|---|---|
| 4,538,974 | A * | 9/1985 | Stich et al. | 418/26 |
| 8,011,908 | B2 * | 9/2011 | Williamson et al. | 418/26 |
| 2003/0137316 | A1 * | 7/2003 | Kazama | 324/761 |
| 2007/0224067 | A1 * | 9/2007 | Arnold et al. | 418/26 |

FOREIGN PATENT DOCUMENTS

| | | | |
|---|---|---|---|
| JP | 2-124287 | U | 10/1990 |
| JP | 5-52188 | A | 3/1993 |
| JP | 5-79469 | A | 3/1993 |
| JP | 5-75492 | U | 10/1993 |

OTHER PUBLICATIONS

Japanese Office Action dated Nov. 15, 2011 (Five (5) pages).

* cited by examiner

*Primary Examiner* — Charles Freay
*Assistant Examiner* — Todd D Jacobs
(74) *Attorney, Agent, or Firm* — Crowell & Moring LLP

(57) ABSTRACT

A variable displacement pump includes: a pump section arranged to be driven by an internal combustion engine, and to discharge a lubricant introduced from an induction portion to a plurality of hydraulic chambers, through a discharge portion, by volume variations of the hydraulic chambers; a variable mechanism arranged to move a movable member by using the discharge pressure of the lubricant, and to vary volumes of the hydraulic chambers which are opened to the discharge portion; and an urging section arranged to urge the movable member in a direction to increase quantities of the volume variations of the hydraulic chambers, the urging section having a spring constant which increases as a movement distance of the movable member in a direction to decrease the quantities of the volume variations of the hydraulic chambers increases.

11 Claims, 24 Drawing Sheets

VARIABLE DISPLACEMENT PUMP

BACKGROUND OF THE INVENTION

This invention relates to a variable displacement pump arranged to supply a lubricant to sliding portions of an internal combustion engine for a vehicle, and a variable valve actuating system arranged to control an actuation characteristic of valves of the engine.

Published Japanese Patent Application Publication No. 5-79469 shows a variable displacement vane pump including a pump housing; an induction opening and a discharge opening located on the both side portions of the pump housing; a driving shaft positioned at a central portion of the pump housing, and to which the torque is transmitted from a crank shaft of an internal combustion engine; a rotor disposed within the pump housing, connected with the driving shaft, and supporting a plurality of vanes located on the outer circumference of the rotor, and arranged to move in the radial direction; and a cam ring swingably disposed on the outer circumference side of the rotor in the eccentric state, and having an outer circumference surface on which ends of the vanes are slidably abutted.

This cam ring is arranged to be swung about a pivot pin in a direction to decrease the eccentric quantity, in accordance with the pump discharge pressure introduced into a hydraulic control chamber separated by a seal member in the outer circumference portion. Moreover, the cam ring is arranged to be swung by a spring force of a single coil spring arranged to push a lever portion integrally formed with the cam ring on the outer circumference, in a direction to increase the eccentric quantity.

That is, in an initial state, the cam ring is urged by the spring force of the coil spring, in the direction in which the eccentric quantity becomes maximum. On the other hand, when the hydraulic pressure within the hydraulic control chamber is equal to or greater than a predetermined quantity, the cam ring is swung against the spring force of the coil spring, in the direction to decrease the eccentric quantity so as to decrease the discharge pressure.

SUMMARY OF THE INVENTION

In the conventional variable displacement pump described above, the pump discharge pressure can increase and decrease by the eccentric quantity of the cam ring.

However, an actual control discharge pressure becomes larger than a necessary discharge pressure, and it is possible to sufficiently decrease the power loss.

It is, therefore, an object of the present invention to provide a variable displacement pump devised to solve the above mentioned problems, and to decrease the power loss.

According to one aspect of the present invention, A variable displacement pump comprises: a pump section arranged to be driven by an internal combustion engine, and to discharge a lubricant introduced from an induction portion to a plurality of hydraulic chambers, through a discharge portion, by volume variations of the hydraulic chambers; a variable mechanism arranged to move a movable member by using the discharge pressure of the lubricant, and to vary volumes of the hydraulic chambers which are opened to the discharge portion; and an urging section arranged to urge the movable member in a direction to increase quantities of the volume variations of the hydraulic chambers, the urging section having a spring constant which increases as a movement distance of the movable member in a direction to decrease the quantities of the volume variations of the hydraulic chambers increases.

According to another aspect of the invention, a variable displacement pump comprises: a pump section arranged to be driven by an internal combustion engine, and to discharge a lubricant introduced from an induction portion to a plurality of hydraulic chambers, through a discharge portion, by volume variations of the hydraulic chambers; a variable mechanism arranged to move a movable member by using the discharge pressure of the lubricant, and to vary volumes of the hydraulic chambers which are opened to the discharge portion; and an urging section including a plurality of spring members arranged to urge the movable member in a direction to increase quantities of volume variations of the hydraulic chambers, at least one of the spring members having a spring load in a disposed state.

According to still another aspect of the invention, a variable displacement pump comprises: a pump section arranged to be driven by an internal combustion engine, and to discharge a lubricant introduced from an induction portion to a plurality of hydraulic chambers, through a discharge portion to the engine, by volume variations of the hydraulic chambers; a variable mechanism arranged to move a movable member by using the discharge pressure of the lubricant, and to vary volumes of the hydraulic chambers which are opened to the discharge portion; and an urging section arranged to urge the movable member in a direction to increase the variation quantities of the volumes of the hydraulic chambers, the urging section having a nonlinear characteristic which is hard to move the movable member when the movable member is moved a large distance in a direction opposite to the urging direction of the movable member.

According to still another aspect of the invention, a variable displacement pump comprises: a driving shaft driven by an internal combustion engine; a pump section arranged to supply a lubricant introduced from an induction portion, through a discharge portion to the internal combustion engine, and to pressurize the lubricant from the induction port by the rotation of the driving shaft; a movable member arranged to vary a discharge quantity from the discharge portion of the pump section by movement of the movable member; and an urging section including a first spring member and a second spring member arranged to urge the movable member in a direction to increase the discharge quantity from the discharge portion of the pump section, the first spring member acting when a movement distance of the movable member is smaller than a predetermined distance, and the first and second spring members acting when the movement distance of movable member is greater than the predetermined distance.

DETAILED DESCRIPTION OF THE INVENTION

Hereinafter, variable displacement pumps according to embodiments of the present invention will be illustrated in detail with reference to the drawings. In these embodiments, the present invention is applied to oil pumps arranged to supply an lubricant of an internal combustion engine for a vehicle, to sliding portions of the engine, and to a valve timing control apparatus which is a variable valve actuating device configured to control opening and closing timings of valves of the engine.

First Embodiment

Figure 1:
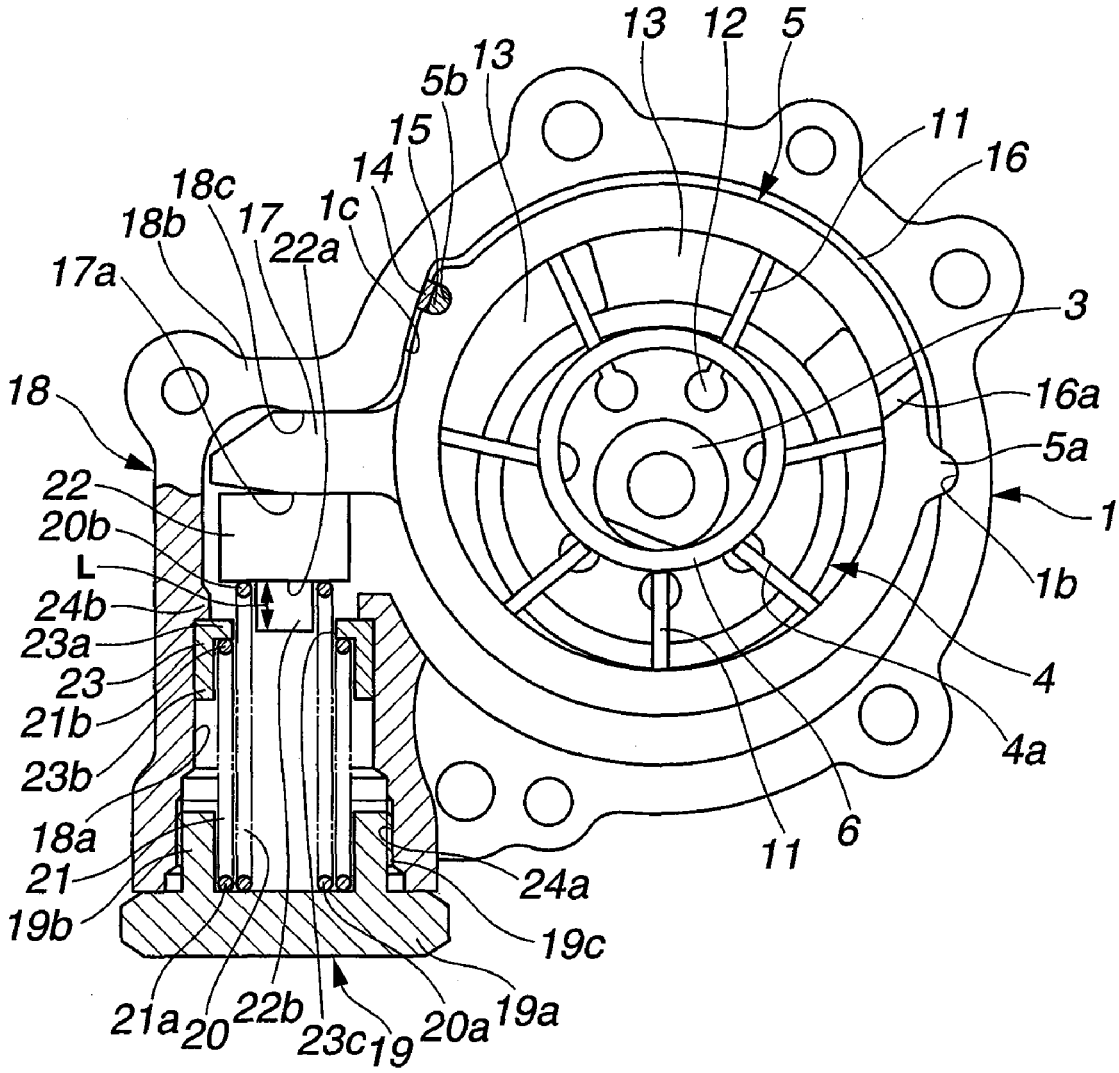
FIG. 1 is a partially sectional front view showing a variable displacement pump according to a first embodiment of the present invention.
Figure 2:
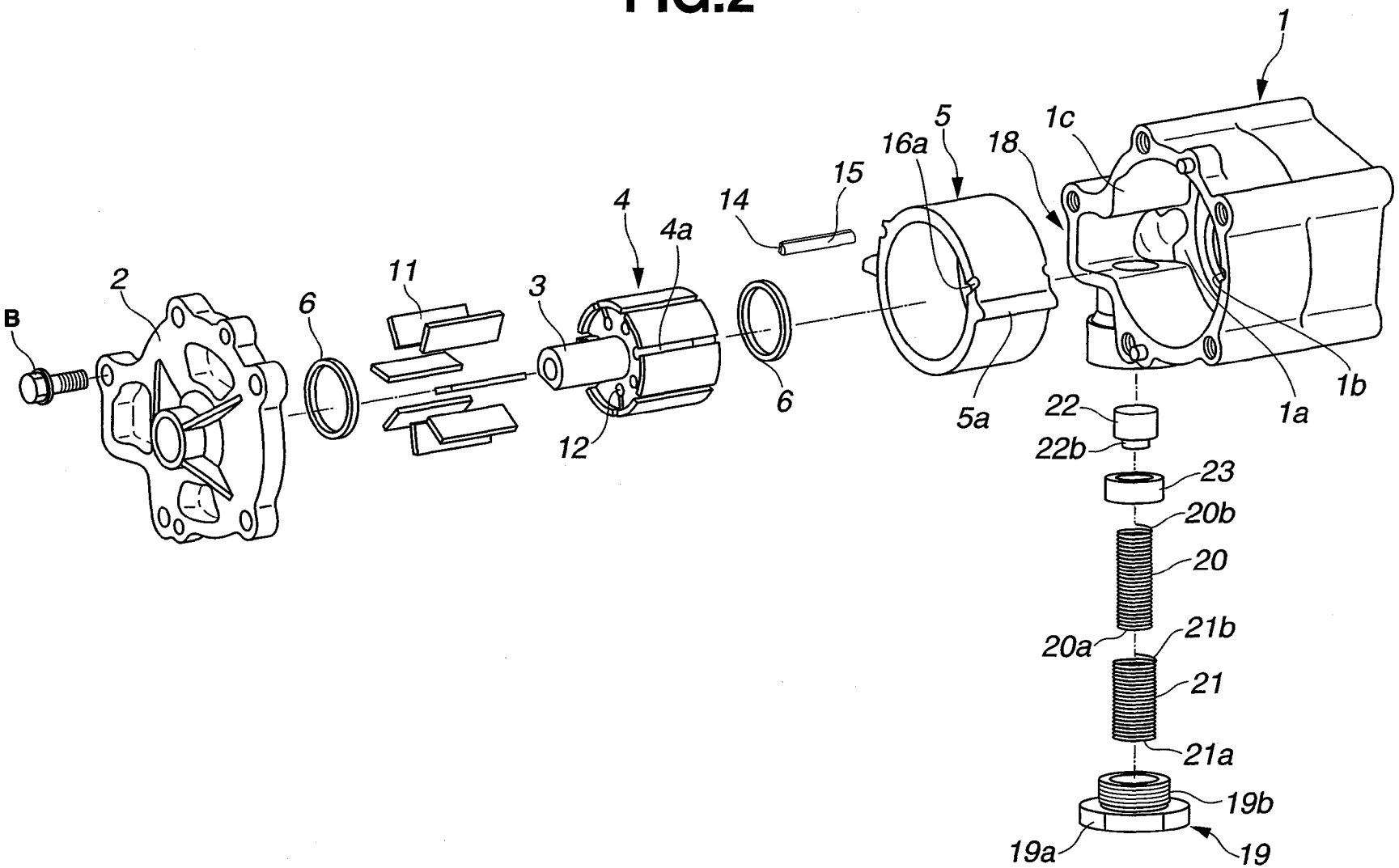
FIG. 2 is an exploded perspective view showing the variable displacement pump of FIG. 1.

FIG. 1 is a partially sectional front view showing a variable displacement pump according to a first embodiment of the present invention. FIG. 2 is an exploded perspective view showing the variable displacement pump of FIG. 1. The variable displacement pump according to the first embodiment is applied to a vane type, and formed at a front end portion of a cylinder block of the internal combustion engine. The variable displacement pump includes a pump housing 1 which is a cylindrical shape having a cover, and which has an opening located at one end thereof, and closed by a cover 2; a driving shaft 3 penetrating through a substantially center portion of pump housing 1, and rotatably driven by a crank shaft of an engine; a rotor 4 rotatably received within pump housing 1, having a substantially H-shaped section in the axial direction, and having a central portion connected with driving shaft 3; a cam ring 5 which is a movable member swingably disposed on an outer circumference side of rotor 4; and a pair of vane rings 6 and 6 each having a small diameter, and slidably disposed on both side surfaces of rotor 4 on the inner circumference side of rotor 4.

Figure 3:
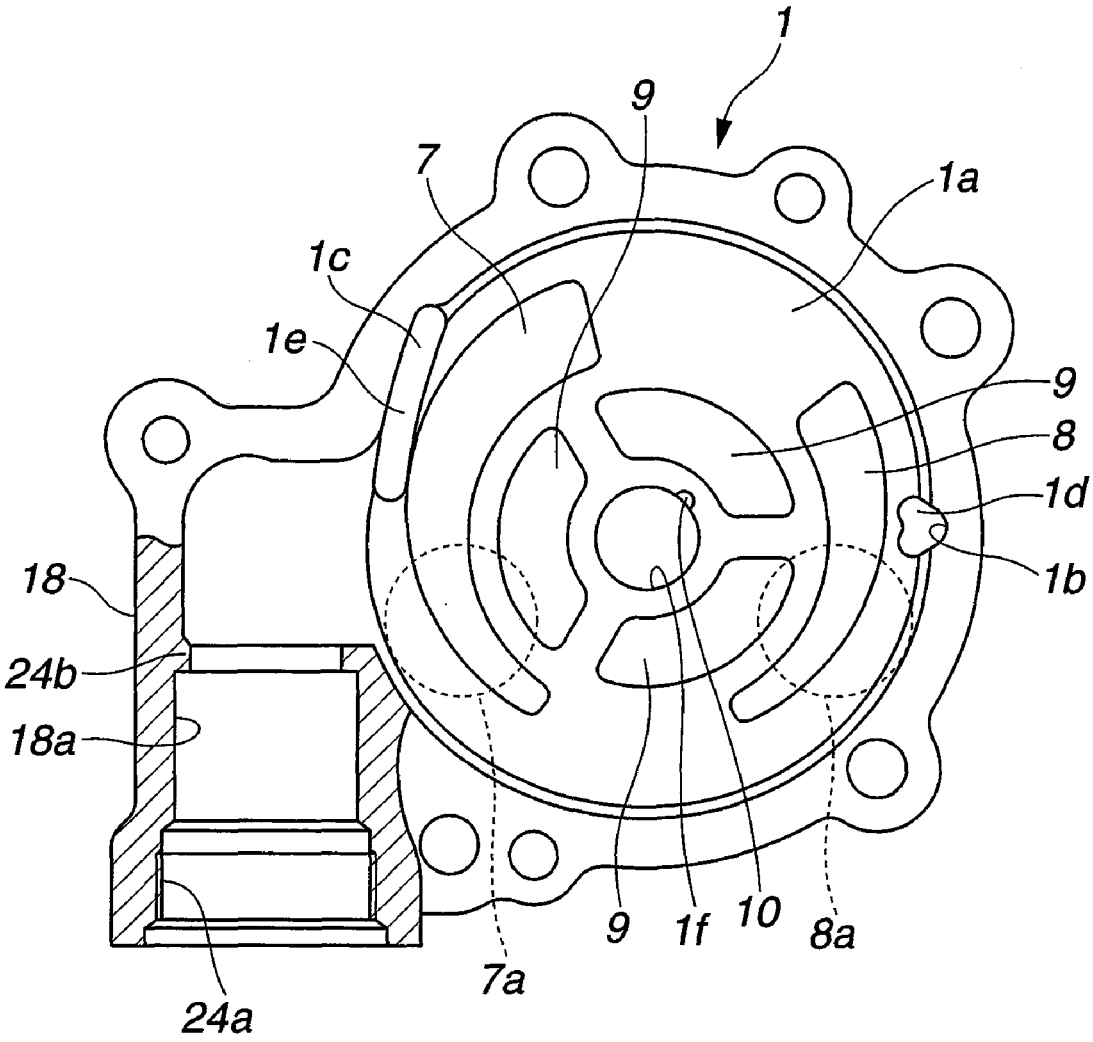
FIG. 3 is a front view showing a pump housing provided to the variable displacement pump of FIG. 1.

Pump housing 1 is integrally formed from aluminum alloy. Pump housing 1 includes a bottom surface 1*a* having a recessed shape, and on which one side surface of cam ring 5 is slid, as shown in FIG. 3. Accordingly, pump housing 1 is formed with high accuracy of flatness and surface roughness, and the sliding portion is formed by machining. Pump housing 1 includes a receiving portion 1*b* which is located at a predetermined position of an inner circumference surface of pump housing 1, which has a substantially circular recessed groove shape, and which is a pivot point of cam ring 5; and a seal sliding surface 1*c* on which a seal member 14 described later is slidably abutted. Seal sliding surface 1*c* has an arc shape having receiving portion 1*b* as the center.

Receiving portion 1*b* and seal sliding surface 1*c* are formed into a curve shape with a small R. Accordingly, receiving portion 1*b* and seal sliding surface 1*c* are manufactured by a relatively small tool to decrease manufacturing time period. In the case of manufacturing receiving portion 1*b* and seal sliding surface 1*c*, there are formed, as manufacturing trail, a heart-shaped minute recessed portion 1*d* and an elongated minute recessed portion 1*e*. Therefore, it does not get in the way of the swing movement of cam ring 5 for minute recessed portions 1*d* and 1*e*.

In bottom surface 1*a* of pump housing 1, there are formed an induction port 7 which has a substantially crescent shape, and which is located on the left side of FIG. 3 on the seal sliding portion 1*c*'s side; and a discharge port 8 which has a substantially crescent shape, and which is located on the right side of FIG. 3 on the receiving portion 1*b*'s side. Induction port 7 confronts discharge port 8 in the radial direction.

As shown in FIG. 3, induction port 7 is connected with an induction opening 7*a* for inhaling the lubricant within an oil pan (not shown). Discharge port 8 is connected from a discharge opening 8*a* through an oil main gallery to the sliding portions and the variable valve acting device. Moreover, on an outer circumference side of bearing hole 3 formed at the center portion of bottom surface 1*a*, there are formed three oil storing portions 9 arranged to temporarily store the lubricant discharged from discharge port 8, and arranged in the circumferential direction at regular intervals. Oil storing portions 9 supplies the lubricant through a bearing oil-supply groove 10 to bearing hole if, and to the both side surfaces of rotor 4 and side surfaces of vanes 11 described later to ensure the lubricity.

Cover 2 has a flat inner surface in this embodiment. However, it is possible to form the induction opening, the discharge opening and the oil storage portions in the flat inner surface of cover 2, like bottom surface 1*a*. This cover 2 is mounted to the housing body by the plurality of bolts B.

Driving shaft 3 rotates rotor 4 in a clockwise direction in FIG. 1 by a torque transmitted from the crank shaft. A left half part in FIG. 1 corresponds to an induction process. A right half part in FIG. 1 corresponds to a discharge process.

Rotor 4 includes a plurality of slots 4*a* each extending radially outwards from a radial inner end, and each slidably receiving one of vanes 11. At the radial inner end of each slot 4*a*, there is formed a back pressure chamber 12 which has a substantially circular section, and which is arranged to introduce the discharge pressure discharged to discharge port 8.

Each of vanes 11 has the radial inner end slidably abutted on the outer circumference surface of vane ring 6, and the radial outer end slidably abutted on inner circumference surface 5*a* of cam ring 5. Moreover, a pump chamber 13 is liquid-tightly separated by the adjacent two of vanes 11, the inner circumference surface of cam ring 5, the outer circumference surface of rotor 4, bottom surface 1*a* of pump housing 1, and the inner surface of cover 2. Vane rings 6 are arranged to push each vane 11 radially outwards.

Cam ring 5 is integrally formed from the workable sintered metal into a substantially cylindrical shape. Cam ring 5 includes a circular raised pivot portion 5*b* integrally formed with cam ring 5, extending in the axial direction, and fit into receiving portion 1*b*, and serving as an eccentric swing point about which cam ring 5 is swung in the eccentric manner. At a circumferential position of cam ring 5 which is radially opposite to pivot portion 5*b*, there is provided a seal member 14 slidably abutted on seal sliding surface 1*c* when cam ring 5 is swung in the eccentric manner.

This seal member 14 is formed from a synthetic resin and so on having low abrasion characteristic. Seal member 14 is formed into an elongated shape extending in the axial direction of cam ring 5. Seal member 14 is urged and pushed in the forward direction toward seal sliding surface 1*c* by the elastic force of an elastic member 15 made from the rubber, and fixed within a circular holding groove 5*b* formed by cutting an outer circumference of cam ring 5. Accordingly, the liquid-tightness of a hydraulic control chamber 16 described later is appropriately ensured.

Hydraulic control chamber 16 having a crescent shape is separated by the outer circumference of cam ring 5, pivot portion 5*a*, seal member 14, and the inner circumference of pump housing 1. Cam ring 5 is formed with an guide groove 16*a* located at a front end surface of cam ring 5, and arranged to guide the discharge pressure discharged from discharge port 8 to hydraulic control chamber 16. Hydraulic control chamber 16 swings cam ring 5 by the discharge pressure introduced from guide groove 16*a* about pivot portion 5*a* in a counterclockwise direction, and moves cam ring 5 in a concentric direction by decreasing an eccentric quantity of cam ring 5 with respect to rotor 4. Guide groove 16*a* may be formed to pass through a circumferential wall of cam ring 5, in place of the front end surface of cam ring 5.

Moreover, cam ring 5 includes an arm 17 integrally provided to cam ring 5, located at a circumferential position opposite to pivot portion 5*a* of the outer circumference surface, and protruding radially outwards. This arm 17 includes a lower surface 17*a* having an end portion with a circular curved shape.

A pump section includes pump housing 1, driving shaft 3, rotor 4, cam ring 5, induction port 7, discharge port 8, and vanes 11.

At a circumferential position opposite to pivot portion 5*a* of pump housing 1, there is provided an urging section arranged to constantly urge cam ring 5 through arm 17 in a direction in which cam ring 5 is brought to the maximum eccentric state.

This urging section includes a cylinder body 18 including a cover, having a cylindrical shape, integrally provided with pump housing 1, and made from aluminum alloy; a plug 19 closing a lower end opening of cylinder body 18; an inner first coil spring 20 and an outer second coil spring 21 which are compression spring members disposed within cylinder body 18, and arranged in parallel with each other; a first plunger 22 which is a pressing member disposed between an upper end portion 20*b* of first coil spring 20 and lower surface 17*a* of arm 17; and a second plunger 23 which is a pressing member disposed at an upper end portion 21*b* of second coil spring 21, and slidably guided by the inner circumference surface of cylinder body 18.

Cylinder body 18 includes an inner circumference surface 18*a* having a large diameter portion, a middle diameter portion and a small diameter portion disposed from the lower side to the upper side in FIG. 1. At the inner circumference surface of the lower opening with the large diameter, there is formed an internal thread 24*a* into which an external thread portion 19*c* formed on the outer circumference of plug 19 is screwed. Between the middle diameter portion and the small diameter portion, there is formed an annular stopper protrusion 24*b* on which the outer circumference portion of second plunger 23 is abutted. Cylinder body 18 includes an upper wall 18*b* having a lower surface 18*c* abutted on an upper surface of arm 17 when arm 17 is pivoted in the clockwise direction by the spring force of first and second coil springs 20 and 21 to restrict the maximum eccentric position of cam ring 5.

Plug 19 includes a cover portion 19*a* located at lower side, and having a substantially disc shape; and a cylindrical portion 19*b* formed integrally with cover portion 19*a*, protruding upwardly from an upper surface of cover portion 19*a*, and extending from the lower end opening into cylinder body 18. Cylindrical portion 19*b* of plug 19 includes external thread 19*c* located on the outer circumference surface of cylindrical portion 19*b*. Accordingly, it is possible to adjust the screw quantity between external thread 19*c* and internal thread 24*a*. The upper surface of the outer circumference portion of cover portion 19*a* is abutted on the lower end of cylinder body 18, and accordingly it is possible to restrict the screw quantity.

First coil spring 20 has a coil diameter smaller than a coil diameter of second coil spring 21. First coil spring 20 is disposed radially inside second coil spring 21. First coil spring 20 has an axial length longer than an axial length of second coil spring 21. First coil spring 20 includes a lower end portion 20*a* abutted on an upper surface of cover portion 19*a*; and upper end portion 20*b* abutted on the lower surface of plunger 22. First coil spring 20 has a predetermined spring set load W1. This spring set load W1 is a load at which cam ring 5 starts to move when the hydraulic pressure is a necessary pressure P1 of the variable valve actuating system.

First plunger 22 is formed into a solid cylindrical shape. First plunger 22 includes a flat upper surface constantly abutted on lower surface 17*a* of arm 17; and a cylindrical protrusion 22*b* having a small diameter, and integrally formed at the central portion on the lower surface thereof. Upper end portion 20*b* of first coil spring 20 is fit over and supported by protrusion 22*b* of first plunger 22. Protrusion 22*b* has such an axial length L that protrusion 22*b* passes through a spring through hole 23*c* of upper wall 23*a* of second plunger 23. This structure suppresses the falling and the twist when first coil spring 20 is compressed or extended, and ensures constant smooth compression and extension. Moreover, it is possible to form first plunger 22 into a hollow cylinder for decreasing the weight.

Second coil spring 21 includes a lower end portion 21*a* abutted on the upper surface of cover portion 19*a*; and upper end portion 21*b* abutted on the lower surface circumference portion of the upper wall of second plunger 23. Second coil spring 21 has a predetermined spring set load W2. Second coil spring 21 has an inside diameter sized to avoid the interference between the outer circumference surface of first coil spring 20 and the inner circumference surface of second coil spring 21, and to freely compress and extend first and second coil spring 20 and 21 even when first coil spring 20 is compressed and extended. The predetermined spring load W2 is a load at which cam ring 5 starts to move when the hydraulic pressure is a necessary hydraulic pressure P2 at the maximum rotation of the crank shaft.

First coil spring 20 has a winding direction opposite to a winding direction of second coil spring 21. Accordingly, first and second coil spring 20 and 21 are not engaged with each other when first and second coil spring 20 and 21 are compressed and extended, and it is possible to attain smooth compression and extension always.

Second plunger 23 has a cover, and has a U-shaped section in the longitudinal direction. Second plunger 23 is formed from meta such as iron. Second plunger 23 includes a circular upper wall 23*a*, a cylindrical portion 23*b* downwardly extending from the outer circumference of upper wall 23*a*. At a central portion of upper wall 23*a*, there is formed a spring insertion hole 23*c* which penetrates in the upward and downward directions, and through which second coil spring 21 is inserted. This spring insertion hole 23*c* has an inside diameter sized to avoid the interference with the outer circumference surface of first coil spring 20 when first coil spring 20 is compressed, and to be smaller than the outside diameter of first plunger 22. Accordingly, the outer circumference portion of lower surface 22*a* of first plunger 22 is abutted on the outer circumference portion of the upper surface of upper wall 23*a* when first plunger 22 is moved downwards to a predetermined position by arm 17 of cam ring 5.

Second plunger 23 is slidably guided and moved in the upward and downward directions within the middle diameter portion of inner circumference surface 18*a* of cylinder body 18. The outer circumference portion of upper wall 23*a* abuts on stopper protrusion 24*b*, so that second plunger 23 is restricted to move in the upward direction.

It is optional to provide a spacer with an appropriate length between cover portion 19*a* of plug 19 and the lower end of cylinder body 18 with the opening, and to vary a length which plug 19 is screwed into cylinder body 18. Thereby, it is possible to freely vary the spring forces of first and second coil springs 20 and 21.

The volume of each pump chamber 13 is varied in accordance with the eccentric quantity of cam ring 5 which varies by the relative force between the spring forces of first and second coil springs 20 and 21 and the discharge pressure within hydraulic control chamber 16. Accordingly, the discharge pressure discharged from inlet port 7 through each pump chamber 13 to discharge port 8 is varied.

Cam ring 5, vane rings 6 and 6, hydraulic control chamber 16, and so on constitute a variable mechanism.

Figure 6:
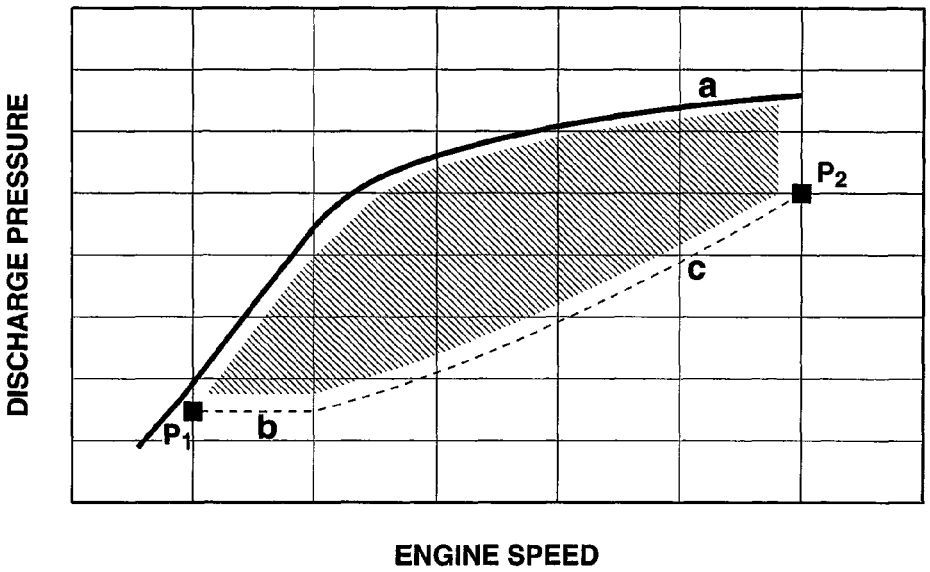
FIG. 6 is a characteristic view showing a relationship between a discharge hydraulic pressure and an engine speed.

Hereinafter, the operation of the variable displacement pump according to the first embodiment of the present invention will be illustrated. FIG. 6 is a characteristic view showing a relationship between a control hydraulic pressure and a necessary hydraulic pressure to the sliding portions of the engine and the valve timing actuating device in the conventional variable displacement pump.

The hydraulic pressure necessary for the internal combustion engine is mainly determined by the hydraulic pressure necessary for lubricating the bearings of the crank shaft. This hydraulic pressure increases as the engine speed increases, as shown by a broken line c of FIG. 6. For satisfying the hydraulic pressure necessary for entire engine speed, the hydraulic pressure at which the cam ring starts to move is set to a necessary hydraulic pressure P2 at the maximum engine speed. Consequently, the control hydraulic pressure rises from the low engine speed, and increases as the engine speed increases, as shown by a solid line a of FIG. 6.

In a case of using the variable valve actuating device for improving the fuel economy and the exhaust emission, the hydraulic pressure of the oil pump is used as the source for actuating this device. For improving the responsiveness of this device, the high hydraulic pressure P1 shown by a broken line b is required from the low engine speed. Therefore, the hydraulic pressure necessary for the entire internal combustion engine is sufficiently satisfied by the entire broken line connecting broken lines b and c.

However, in the conventional variable displacement pump, the cam ring is urged in the maximum eccentric direction by a single coil spring with a constant spring load. Therefore, the characteristic of the control pressure becomes the high pressure corresponding to the increase of the engine speed shown by solid line a of FIG. 6 as described above. In a portion indicated by oblique lines in FIG. 6, the hydraulic pressure increases more than necessary, and it is not possible to suppress the power loss sufficiently.

Figure 7:
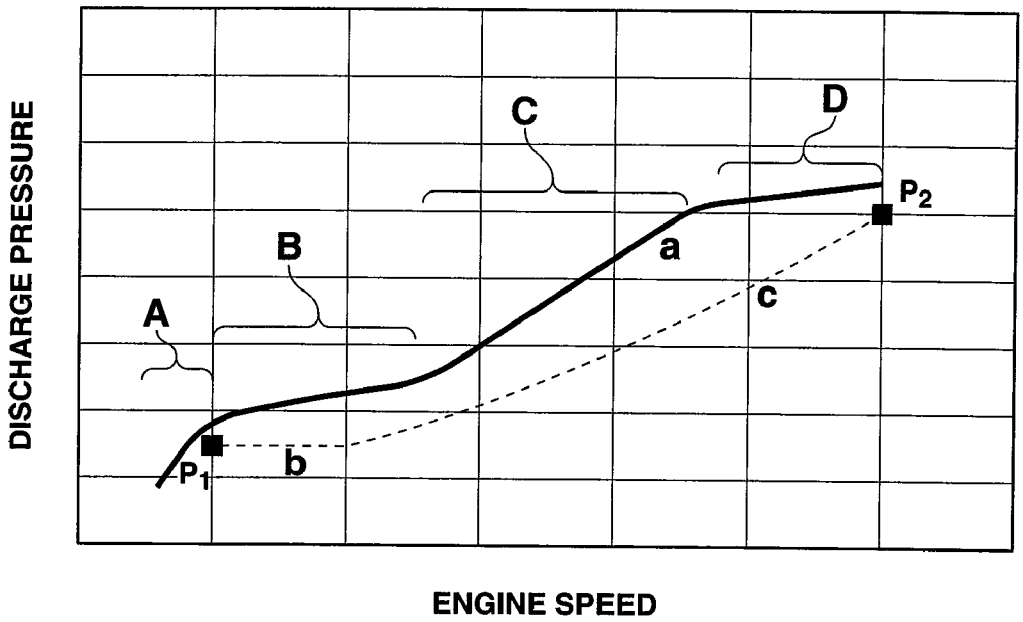
FIG. 7 is a characteristic view showing a relationship between a discharge hydraulic pressure and the engine speed in the variable displacement pump of FIG. 1.

In the variable displacement pump according to the first embodiment of the present invention, the pump discharge pressure does not reach P1 from the start of engine to the low engine speed, as shown in FIG. 7. Arm 17 of cam ring 5 is pushed against lower surface 18*c* of cylinder body upper wall 18*b* by the spring force of first coil spring 20, so as to be in the stop condition, as shown in FIG. 1. In this case, cam ring 5 is in the maximum eccentric state, and the pump capacity is maximum. Accordingly, the discharge pressure increases (rises) with the increase of the engine speed suddenly relative to the conventional apparatus. The variable displacement pump has a characteristic A shown in a solid line in FIG. 7.

Figure 4:
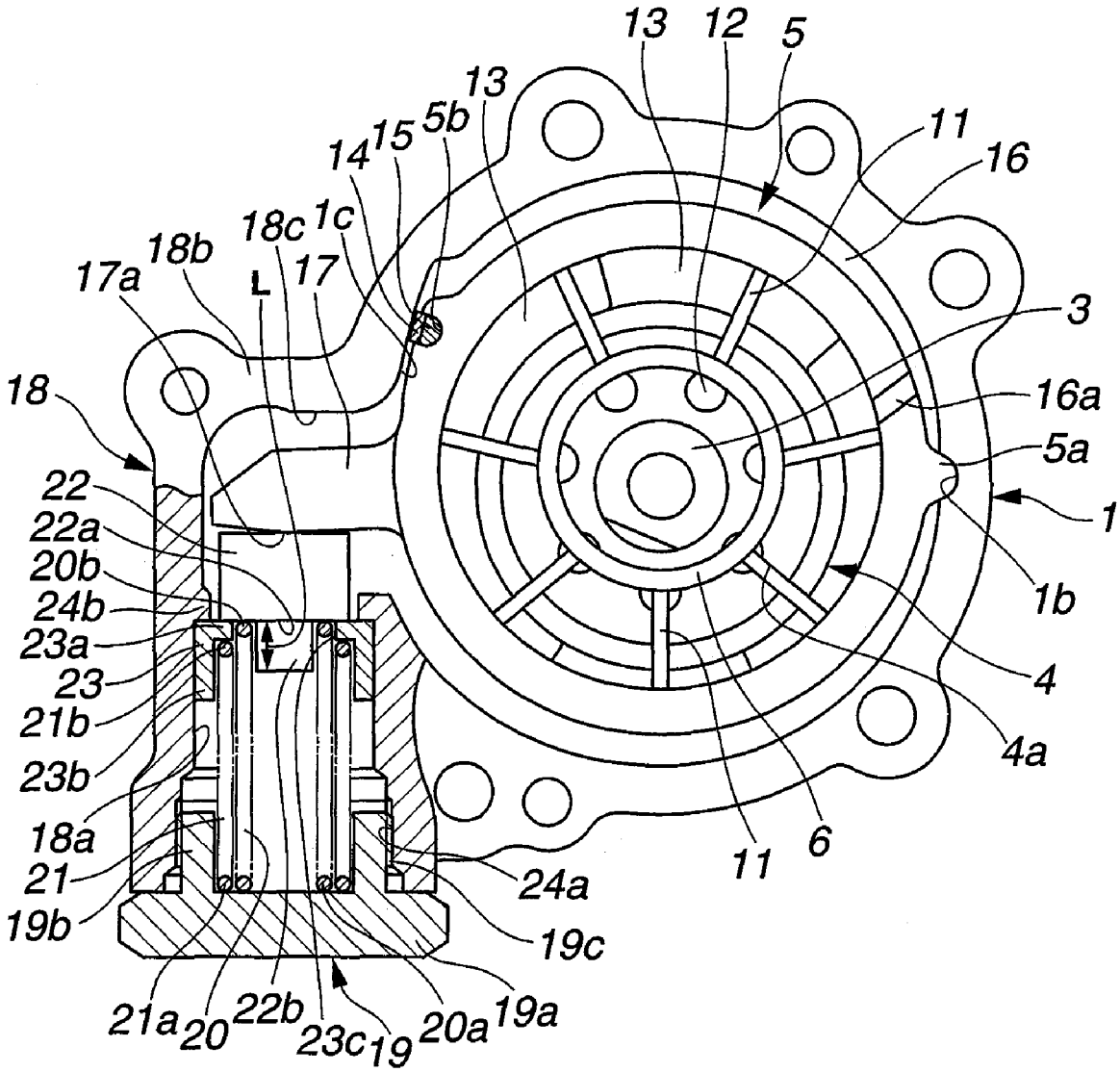
FIG. 4 is an illustrative view showing an operation of the variable displacement pump of FIG. 1.
Figure 5:
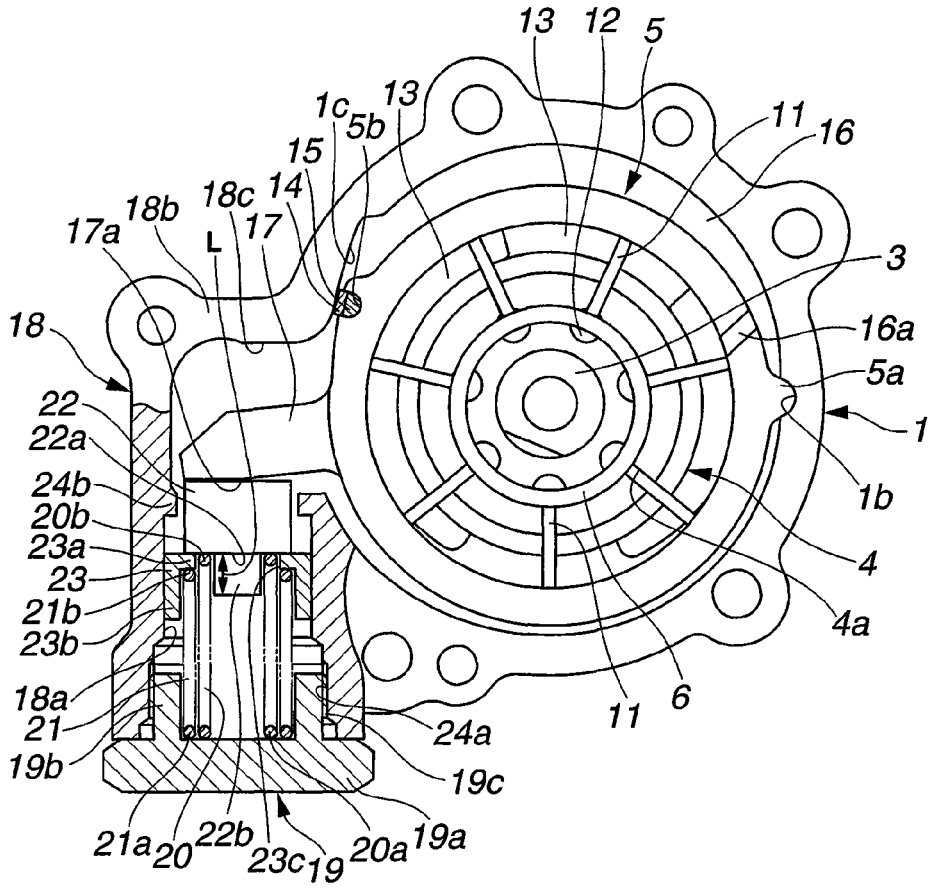
FIG. 5 is an illustrative view showing the operation of the variable displacement pump of FIG. 1.

Next, the discharge pressure further increases with the increase of the engine speed, and reaches P1 of FIG. 7. In this case, the hydraulic pressure introduced into hydraulic control chamber 16 increases, and cam ring 5 starts to compress first coil spring 20 acted to arm 17, and is pivoted about pivot portion 5*a* in the counterclockwise direction in the eccentric manner. Consequently, the pump capacity decreases, so that the increasing characteristic of the discharge pressure decreases as shown in region B of FIG. 7. Then, cam ring 5 is swung in the counterclockwise direction until lower surface 22*a* of first plunger 22 is abutted on the outer circumference surface of upper wall 23*a* of second plunger 23, as shown in FIG. 4. In this state shown in FIG. 4, first plunger 22 is abutted on second plunger 23. From this state, spring load W2 of second coil spring 21 is provided in addition to spring load W1 of first coil spring 20. Cam ring 5 can not be swung to be in the held state until the discharge pressure reaches P2 (hydraulic pressure P2 in hydraulic control chamber 16) and the discharge pressure becomes larger than spring load W2. Accordingly, the discharge pressure has the increasing characteristic shown by C of FIG. 7 with the increase of the engine speed. However, the eccentric quantity of cam ring 5 decreases, and the pump capacity decreases. The increasing characteristic shown by C of FIG. 7 does not become the increasing characteristic shown by A of FIG. 7 which has the sudden increasing.

When the engine speed further increases and the discharge pressure becomes equal to or greater than P2, cam ring 5 is swung against the spring force of spring load W2 of second coil spring 21, and compresses first and second coil springs 20 and 21 through arm 17. With this swing movement of cam ring 5, the pump capacity further decreases, and the increase of the discharge pressure becomes small. The characteristic shown by D of FIG. 7 is held, and the engine speed reaches the maximum engine speed.

Figure 8:
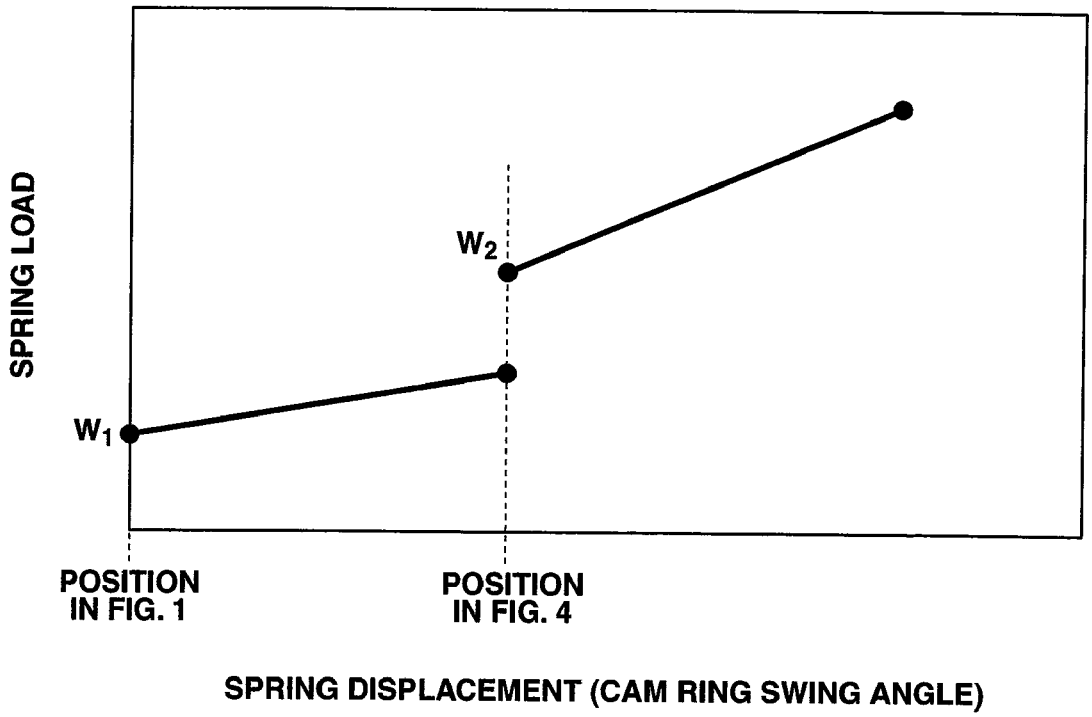
FIG. 8 is a characteristic view showing a relationship between displacements of first and second coil springs and a spring set load.

FIG. 8 shows a relationship between displacement of each of coil springs 20 and 21 or swing angle of cam ring 5 and spring loads W1 and W2. That is, in the initial state from the start to the low engine speed of the internal combustion engine, the spring force of spring load W1 of first coil spring 20 is provided, and it is not possible to move until over spring load W1. After over spring load W1, first coil spring 20 is compressed, and the load is increased. This inclination becomes constant of spring.

At a position shown in FIG. 4, the spring load becomes spring load W2 of second coil spring 21, and increases discontinuously. After the discharge pressure is over spring load W2, first and second coil springs 20 and 21 are compressed again, and the load is increased. However, the two coil springs are operated, the spring constant increases, and the inclination is varied.

As mentioned above, when the discharge pressure reaches P1 by the increasing of the engine speed, cam ring 5 starts to move to restrict the increase of the discharge pressure. When cam ring 5 is moved a predetermined distance, the spring constant becomes large by adding the spring force of second coil spring 21. Spring loads W1 and W2 increase discontinuously. Consequently, cam ring 5 starts to be swung after the discharge pressure increases to P2 again.

In this embodiment, coil springs 20 and 21 have a nonlinear characteristic of the spring force, and accordingly the characteristic of the discharge pressure has a characteristic shown by A~D of FIG. 7. The control pressure (solid line) in FIG. 6 is sufficiently moved closer to the necessary pressure (broken line). Consequently, it is possible to sufficiently decrease the power loss by the unnecessary increase of the hydraulic pressure.

In this embodiment, the two coil springs (first and second coil springs) 20 and 21 are used. Accordingly, it is possible to arbitrarily set each spring load in accordance with the variation of the discharge pressure, and to set appropriate spring force for the discharge pressure.

Moreover, first and second plungers 22 and 23 are provided, respectively, at the end portions of coil springs 20 and 21. Accordingly, it is possible to facilitate the assembling operation, and to smoothly compress and expand coil springs 20 and 21 without causing the twist. In a case in which the movement distances of plungers 22 and 23 and the swing distance of arm 17 are small, it is possible to abut upper end portion 20*b* of first coil spring 20 directly on lower surface 17*a* of arm 17 without through the plunger. That is, the spring load of first and second coil springs 20 and 21 are operated in the stepwise manner, and the spring characteristic becomes a nonlinear state. Consequently, cam ring 5 is swung as mentioned above.

Moreover, lower surface 17*a* of arm 17 is formed into the circular curved shape, and accordingly it is possible to decrease the variation of the abutment angle and the abutment point with the upper surface of first plunger 22 by the swing movement of cam ring 5. Accordingly, it is possible to stabilize the displacement of first coil spring 20. Besides, it is possible to obtain the same effect when the upper surface of first plunger 22 is formed into the circular curved shape.

In this embodiment, the lubricant discharged from the discharge opening through discharge port 8 is used as the source for actuating the valve timing actuating device in addition to the sliding portions of the engine. As mentioned above, the rising of the initial discharge pressure (region A) shown in FIG. 7 becomes the good state. Accordingly, it is possible to improve the actuation responsiveness of the relative rotational phase between the timing sprocket and the cam shaft to the retarded angle side or to the advanced angle side. Moreover, the variable valve actuating device is not limited to the valve timing control device. For example, it is possible to employ a lift variable mechanism which uses the hydraulic pressure as the actuating source, and which varies the working angle and the lift quantity.

Figure 9:
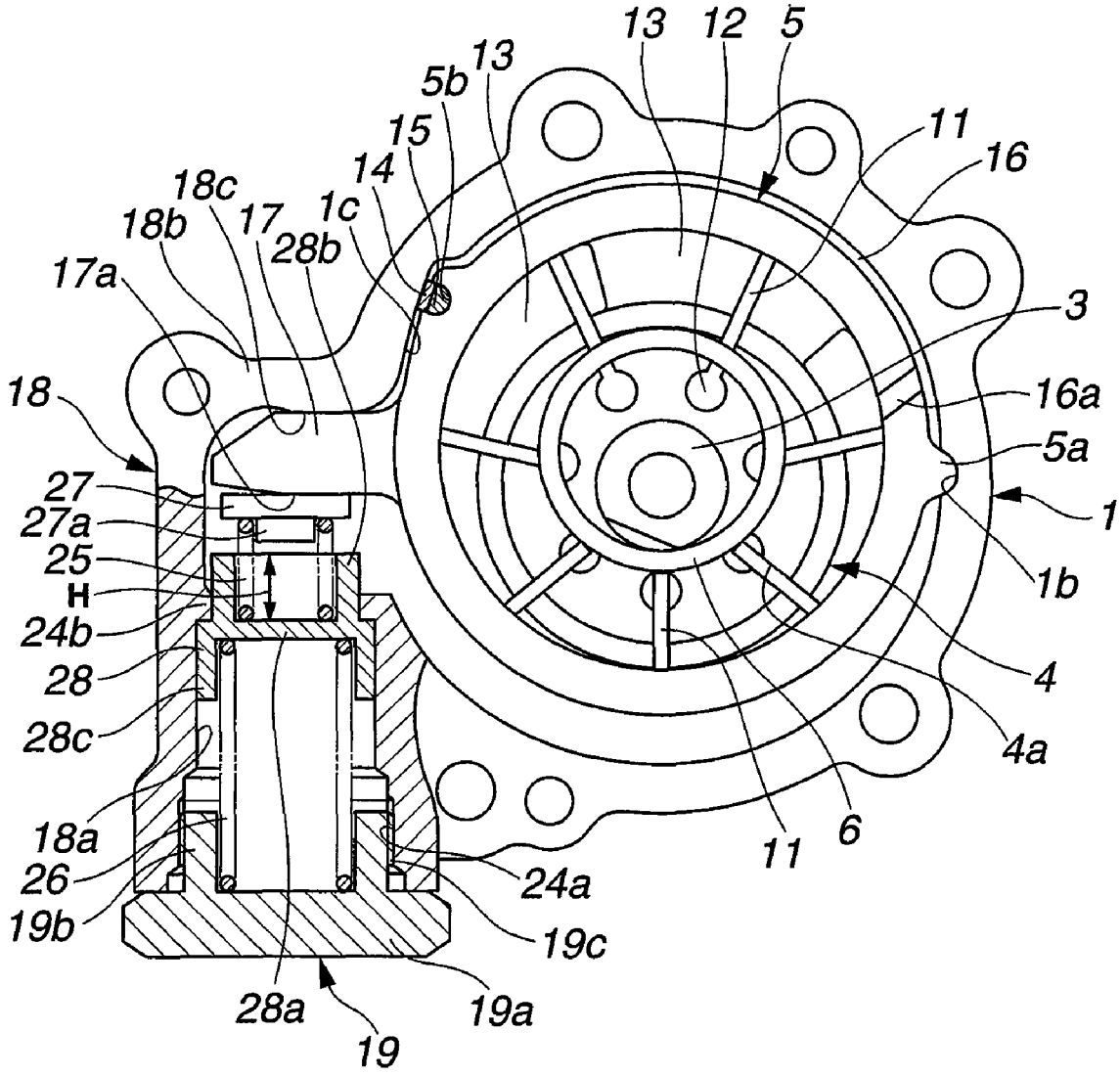
FIG. 9 is a partially sectional front view showing a variable displacement pump according to a second embodiment of the present invention.
Figure 10:
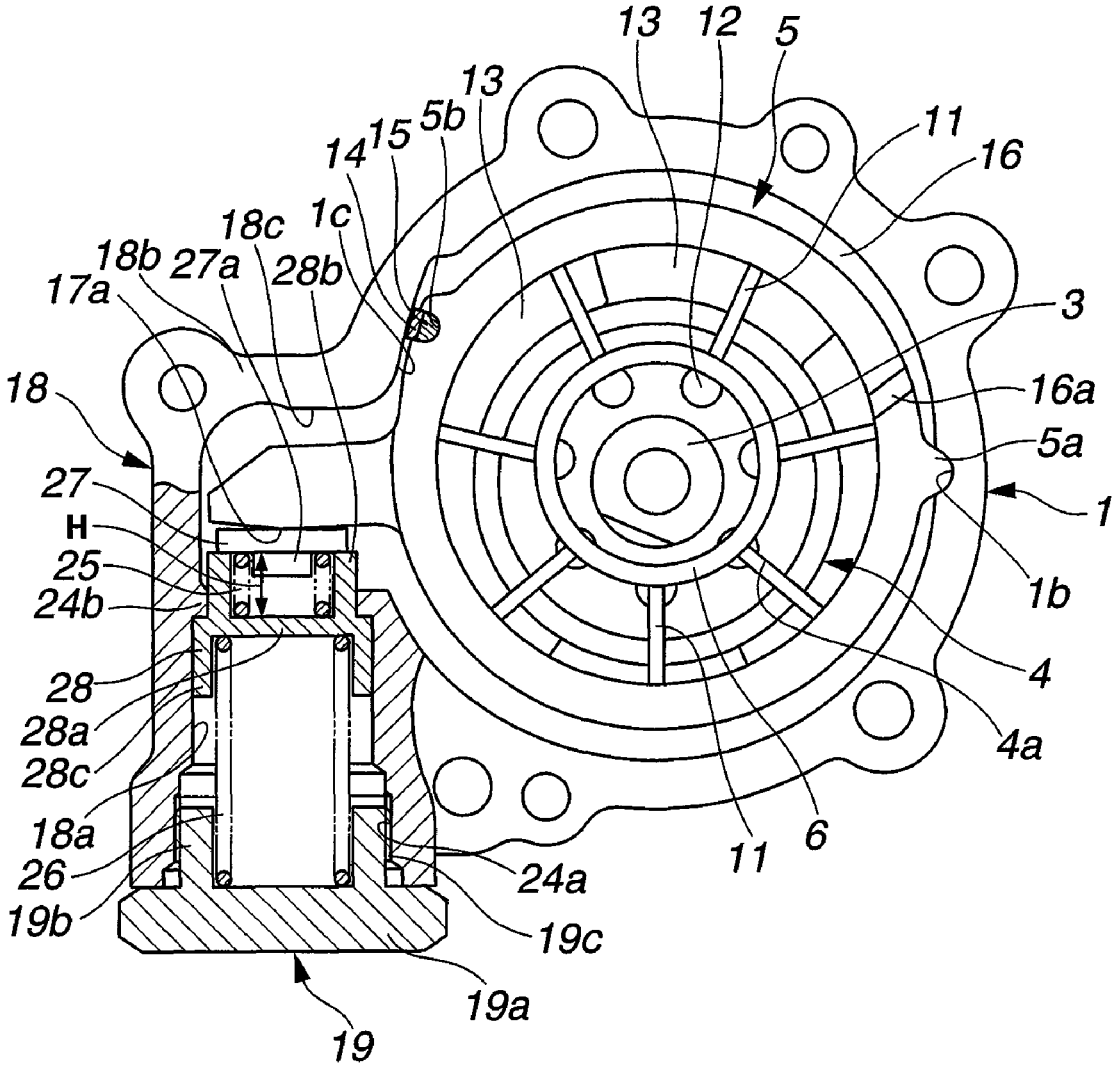
FIG. 10 is an illustrative view showing an operation of the variable displacement pump of FIG. 9.
Figure 11:
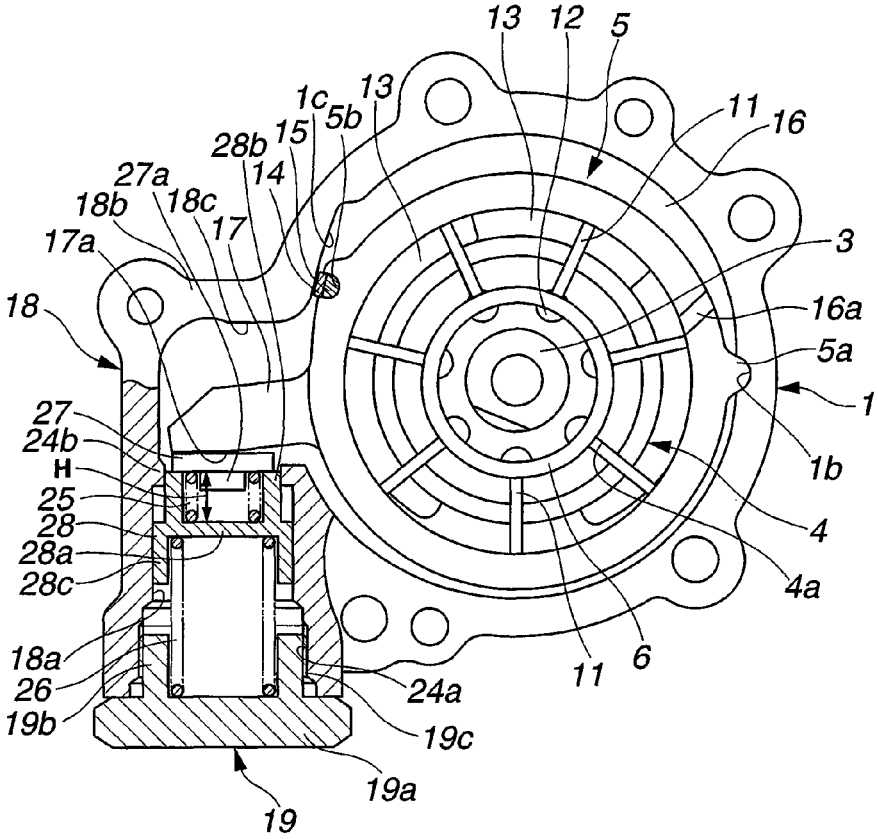
FIG. 11 is an illustrative view showing the operation of the variable displacement pump of FIG. 9.

FIGS. 9~11 shows a variable displacement pump according to a second embodiment of the present invention. The variable displacement pump according to the second embodiment is basically identical to the variable displacement pump according to the first embodiment. However, coil springs of the urging section is different in structure to the coil springs of the first embodiment.

That is, the urging section includes a first coil spring 25 disposed within cylinder body 18; a second coil spring 26 disposed within cylinder body 18, located on the lower side of first coil spring 25, and disposed in series with first coil spring 25 in the axial direction; a first plunger 27 disposed between an upper end portion of first coil spring 25 and lower surface 17*a* of arm 17; and a second plunger 28 disposed between the lower end portion of first coil spring 25 and the upper end portion of second coil spring 26, and arranged to slidably move on inner circumference surface 18*a* of cylinder body 18.

First coil spring 25 has a relatively short length. First coil spring 25 is set to spring set load W1 identical to first coil spring 20 of the first embodiment.

First plunger 27 is formed into a substantially disc shape. First plunger 27 includes an upper surface abutted on circular lower surface 17*a* of arm 17. First plunger 27 includes a substantially cylindrical protruding portion 27*a* integrally formed with first plunger 27 at a substantially central portion of first plunger 27 on the lower surface of first plunger 27, and fit in the upper end of first coil spring 25 by the press fit. This protruding portion 27*a* is arranged to ensure the straight ability at the displacement of spring 25, and to restrict the torsion and the falling.

Second coil spring 26 has a radius of the coil which is slightly larger than the radius of the coil of first coil spring 25. Second coil spring 26 is set to spring load W2 identical to second coil spring 21 of the first embodiment.

Second plunger 28 is formed into a substantially H-shape in a longitudinal section. Second plunger 28 includes a disc-shaped base portion 28*a* located at a central portion of second plunger 28; a cylindrical first protruding portion 28*b* protruding upwards on the outer circumference portion of base portion 28*a*; and a cylindrical second protruding portion 28*c* protruding downwards on the outer circumference portion of base portion 28*a*.

Base portion 28*a* includes an upper surface on which the lower end portion of the first coil spring 25 is abutted; and a lower surface on which the upper portion of second coil spring 26 is abutted. Base portion 28*a* is sandwiched resiliently between first coil spring 25 and second coil spring 26. Base portion 28*a* includes the outer circumference portion on the upper surface which is abutted on stopper protruding portion 24*b* formed on inner circumference surface 18*a* of cylinder body 18. Accordingly, the maximum displacement of second coil spring 26 is restricted.

First protruding portion 28*b* has a length H in the axial direction which is slightly larger than a half of the length of first coil spring 25. First protruding portion 28*b* includes an inner circumference surface which holds the lower end portion of first coil spring 25, and which has an inside diameter so as not to inhibit the compression and the extension of first coil spring 25. Moreover, the outer circumference surface of first protruding portion 28*b* is arranged to slidably move on the inner circumference surface of stopper protruding portion 24*b*.

Second protruding portion 28*c* has an axial length substantially identical to the axial length of first protruding portion 28*b*. Second protruding portion 28*c* includes an inner circumference surface which holds the upper end portion of second coil spring 26, and which has an inside diameter so as not to inhibit the compression and the extension of second coil spring 26. The outer circumference surface of second protruding portion 28*c* is arranged to slidably move on the inner circumference surface 18*a* of cylinder body 18.

The operation in this second embodiment is substantially identical to the operation of the first embodiment. The pump discharge pressure does not reach P1 from the start of the engine to the low engine speed. Arm 17 of cam ring 5 is pushed on lower surface 18*c* of cylinder body upper wall 18*b* by the spring force of first coil spring 25, so as to be in the stop condition, as shown in FIG. 9. In this case, cam ring 5 is in the maximum eccentric state, and the pump capacity is maximum. Accordingly, the discharge pressure suddenly increases (rises) with the increase of the engine speed. The variable displacement pump has characteristic A shown in the solid line in FIG. 7.

When the discharge pressure increases to P1 with the increase of the engine speed, the hydraulic pressure introduced into hydraulic control chamber 16 increases. Cam ring 5 compresses first coil spring 25 acted to arm 17, and cam ring 5 is swung about pivot portion 5*a* in the counterclockwise direction in the eccentric manner. Accordingly, the pump capacity is decreased, and the increase characteristic of the discharge pressure is decreased as shown in region B of FIG. 7. Moreover, cam ring 5 is swung in the counterclockwise direction until the outer circumference portion of the lower surface of first plunger 27 is abutted on the upper edge of first protruding portion 28*b* of second plunger 28, as shown in FIG. 10. In the state shown in FIG. 10, first plunger 27 is abutted on first protruding portion 28*b*. However, second coil spring 26 is set to spring set load W2, cam ring 5 is held and not swung until the discharge pressure reaches P2 (hydraulic pressure P2 in hydraulic control chamber 16) and the discharge pressure becomes larger than spring load W2. In this way, in the case in which first plunger 27 is abutted on second plunger 28, first coil spring 25 is not further compressed and varied.

Accordingly, the discharge pressure becomes increasing characteristic shown in C of FIG. 7 with the increase of the engine speed. However, the pump capacity decreases by the decrease of the eccentric amount of cam ring 5, and the discharge pressure does not become the sudden increase shown in A of FIG. 7.

When the engine speed further increases and the discharge pressure becomes equal to or greater than P2, cam ring 5 is swung against the spring forces of spring load W2 of second coil spring 26, and compresses and varies second coil spring 26 through arm 17, as shown in FIG. 11. With this swing movement of cam ring 5, the pump capacity further decreases, and the increase of the discharge pressure becomes small. The characteristic shown by D of FIG. 7 is held, and the engine speed reaches the maximum engine speed.

Figure 12:
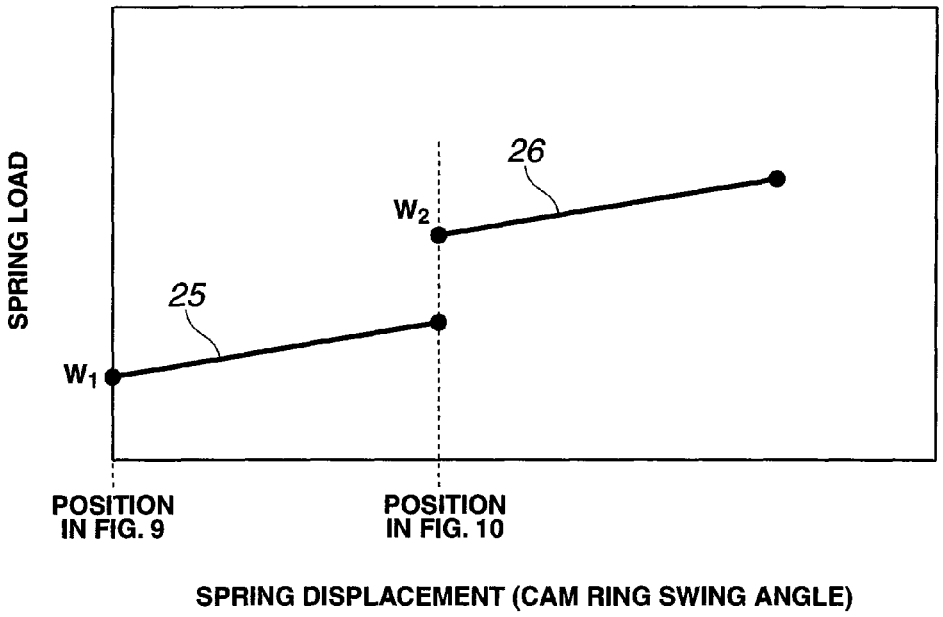
FIG. 12 is a characteristic view showing a relationship between displacements of first and second coil springs and a spring set load.
Figure 13:
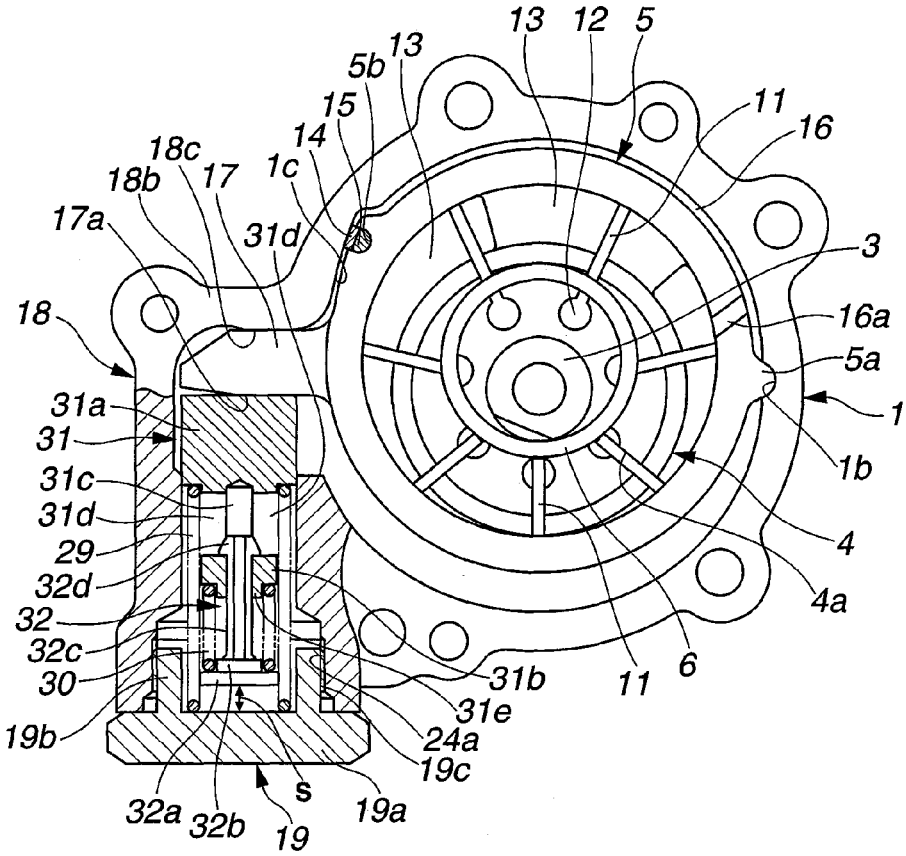
FIG. 13 is a partially sectional front view showing a variable displacement pump according to a third embodiment of the present invention.

FIG. 12 shows a relationship between displacement of each of coil springs 25 and 26 or swing angle of cam ring 5 and spring loads W1 and W2. That is, in the initial state from the start to the low engine speed of the internal combustion engine, the spring force of spring load W1 of first coil spring 25 is provided, and cam ring 5 can not move until over spring load W1. First coil spring 20 is compressed after over load W1, and the load is increased. This inclination is the spring constant.

Spring load W2 of second coil spring 26 is acted from a position shown in FIG. 10, and the spring load increases discontinuously. When the discharge pressure is beyond spring load W2, second coil spring 26 is compressed, and the load is increased. However, second coil spring 26 is compressed unlike the first embodiment. The spring constant after spring set load W2 is determined only by second coil spring 26. It is possible to set the spring constant to the same, or to increase or decrease the spring constant. In this embodiment, the spring constants of first and second coil springs 25 and 26 are set identical to the spring constants in the first embodiment. Accordingly, the variable displacement pump has the spring load characteristic shown by FIG. 12.

Accordingly, this second embodiment can attain the same effect as the first embodiment. In particular, the lower end portion of first coil spring 25 and the upper end portion of second coil spring 26 are held respectively by first protruding portion 28*b* and second protruding portion 28*c* of second plunger 28 when first and second coil springs 25 and 26 are extended and compressed, so as to ensure the straight postures of first and second coil springs 25 and 26. Therefore, it is possible to prevent the falling and the torsion of first and second coil springs 25 and 26.

Third Embodiment

FIGS. 13~16 shows a variable displacement pump according to a third embodiment of the present invention. The basic structure in the third embodiment is identical to the structure in the first embodiment. In the third embodiment, the structure and the arrangement of the coil springs of the urging section and the structure of the plungers are different from the structure and the arrangement in the first embodiment.

The variable displacement pump includes a first coil spring 29 with a relatively large diameter; a second coil spring 30 with a relatively small diameter which is disposed within first coil spring 29 in the parallel state; a first plunger 31 pivoted on the upper end portion of first coil spring 29, and abutted on lower surface 17*a* of arm 17; and a second plunger 32 disposed within first plunger 31, and arranged to move in the upward and downward directions.

First coil spring 29 includes an upper end portion abutted on the outer circumference on the lower side of first plunger 31, and a lower end portion abutted on the upper surface of cover portion 19*a* of plug 19. First coil spring 29 is set to predetermined spring load W1.

Figure 14A:
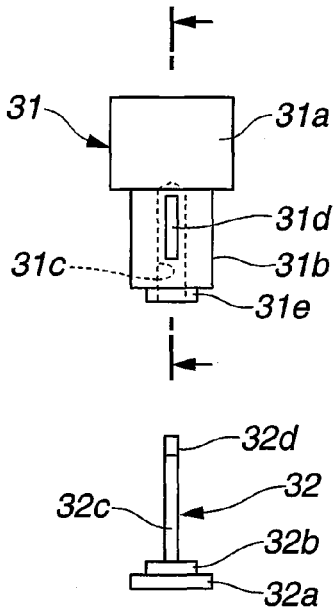
FIG. 14A is an exploded front view showing first and second plungers provided to the variable displacement pump of FIG. 13.
Figure 14B:
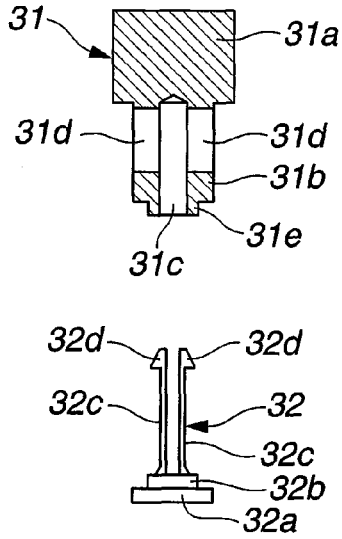
FIG. 14B is a sectional view showing the first and second plunger.

First plunger 31 is formed into a stepped cylindrical shape including a larger diameter portion 31*a* on the upper side, and a smaller diameter portion 31*b* on the lower side, as shown in FIGS. 14A and 14B. Larger diameter portion 31*a* includes a flat upper surface abutted on lower surface 17*a* of arm 17 by the spring force of first coil spring 29. Smaller diameter portion 31*b* includes a through hole 31*c* which is formed at a central portion, and which passes through from the lower surface to the upper surface in the axial direction; and a pair of slits 31*d* and 31*d* positioned on both sides through hole 31*c*, and formed along the upward and downward directions of smaller diameter portion 31*b*. The upper end portion of second coil spring 30 is supported by the outer circumference portion of the lower surface of smaller diameter portion 31*b*. Smaller diameter portion 31*b* further includes a protruding portion 31*e* integrally formed at a central portion of the lower surface of smaller diameter portion 31*b*, and arranged to hold the upper end portion of second coil spring 30.

Second plunger 32 is integrally formed from a synthetic resin. Second plunger 32 includes a disc-shaped supporting portion 32*a* located at a lower end portion, and including an upper surface supporting the lower end portion of second coil spring 30 at the outer circumference thereof; protruding portion 32*b* with a small diameter which is formed on the upper surface of supporting portion 32*a* at the central portion, and which holds the inner circumference of the lower end portion of second coil spring 30; and a pair of stem portions 32*c* and 32 each protruding upwards from the upper surface of protruding portion 32*b* at the central portion, and each arranged to slide within through hole 31*c*. Each of stem portions 32*c* and 32*c* includes an end portion flexible in inward and outward directions, and having a claw portion 32*d* integrally formed with the stem portion 32*d*, engaged within one of slots 31*d*, and arranged to slidably move within one of slots 31*d* in the upward and downward directions.

The lower end portion of second coil spring 30 is supported by the upper surface of supporting portion 32*a*, and the upper end portion of second coil spring 30 is supported by the lower end surface of first plunger 31. Accordingly, second coil spring 30 urges second plunger 32 in a direction apart from first plunger 31. Second coil spring 30 is set to a predetermined spring load W2.

When second plunger 32 is apart from first plunger 31 by a maximum distance by the spring force of second coil spring 30, the lower surface of supporting portion 32*a* is apart from the upper surface of plug cover portion 19*a* by a predetermined distance S.

Figure 15:
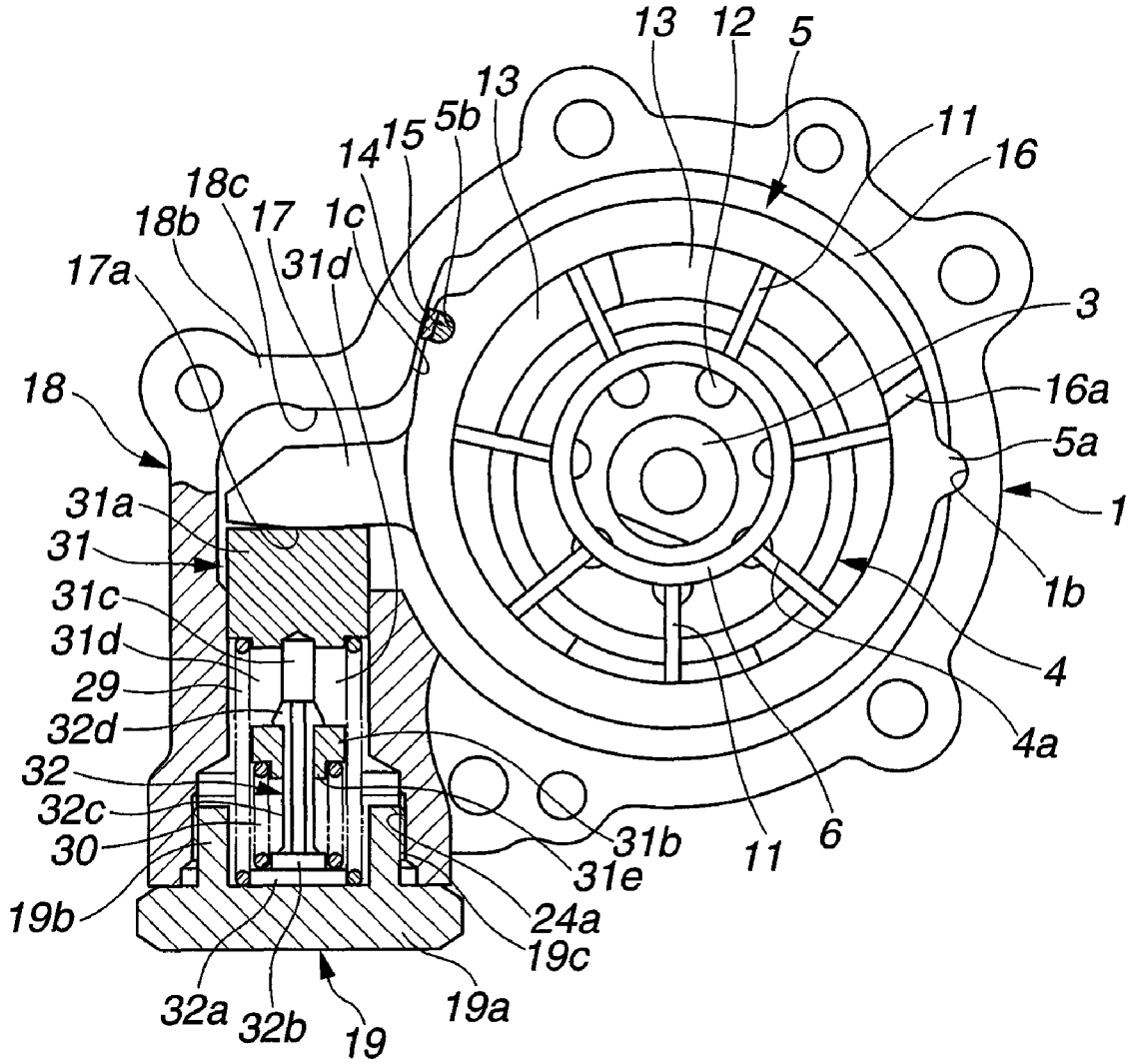
FIG. 15 is an illustrative view showing an operation of the variable displacement pump of FIG. 13.

The operation in this embodiment is substantially identical to the operations in the first and second embodiments. The characteristic of the discharge hydraulic pressure is substantially identical to the characteristic shown by FIG. 7. When the discharge pressure increases to P1 of FIG. 7 with the increase of the engine speed, the hydraulic pressure introduced into hydraulic control chamber 16 increases. Cam ring 5 compresses and varies first coil spring 29 acted to arm 17, and cam ring 5 is swung about pivot portion 5*a* in the counterclockwise direction in the eccentric manner. Accordingly, the pump capacity is decreased, and the increase characteristic of the discharge pressure is decreased as shown in region B of FIG. 7. The lower surface of second plunger 32 is abutted on the upper surface of plug cover portion 19*a* as shown in FIG. 15. However, second coil spring 30 is not yet compressed, and set to spring set load W2. Accordingly, cam ring 5 is held and not swung until the discharge pressure reaches P2 (hydraulic pressure P2 in hydraulic control chamber 16) and the discharge pressure becomes larger than spring load W2.

Accordingly, the discharge pressure becomes increasing (rising) characteristic shown in C of FIG. 7 with the increase of the engine speed. However, the pump capacity decreases by the decrease of the eccentric amount of cam ring 5, and the discharge pressure does not become the sudden increase shown in A of FIG. 7.

Figure 16:
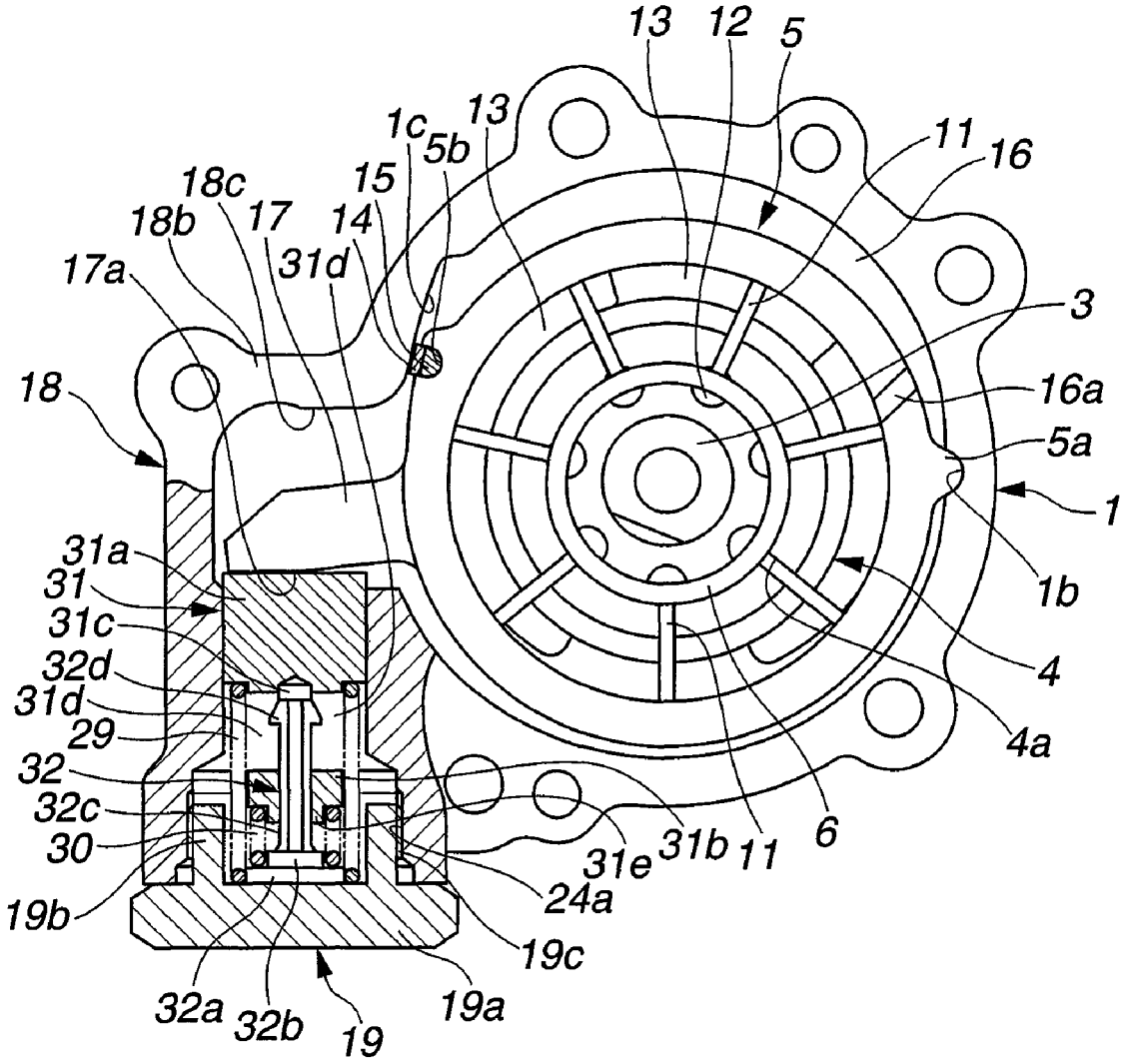
FIG. 16 is an illustrative view showing the operation of the variable displacement pump of FIG. 13.

When the engine speed further increases and the discharge pressure becomes equal to or greater than P2, cam ring 5 is swung against the spring forces of spring loads W1 and W2 of first and second coil springs 29 and 30, and compresses and varies first and second coil springs 29 and 30 through arm 17, as shown in FIG. 16. With this swinging movement of cam ring 5, the pump capacity further decreases, and the increase of the discharge pressure becomes small. The characteristic shown by D of FIG. 7 is held, and the engine speed reaches the maximum engine speed. The relationship between the displacement of each of coil springs 29 and 30 or the swing angle of cam ring 5 and the spring set load is identical to the characteristic shown in FIG. 8 like the first embodiment.

Accordingly, the variable displacement pump in this embodiment can attain the same effect as in the other embodiments. In particular, smaller diameter portion 31*b* of first plunger 31 has the relatively long length in the axial direction. The inner circumference of first coil spring 29 is held on the outer circumference of smaller diameter portion 31*b*. Therefore, it is possible to effectively suppress the falling and the torsion of first coil spring 29 when first coil spring 29 is compressed and extended. The inner circumferences of the both end portions of second coil spring 30 are supported respectively by protruding portion 31*e* and 32*b*. Accordingly, it is possible to prevent the falling and torsion of second coil spring 30 at the displacement.

Fourth Embodiment

Figure 17:
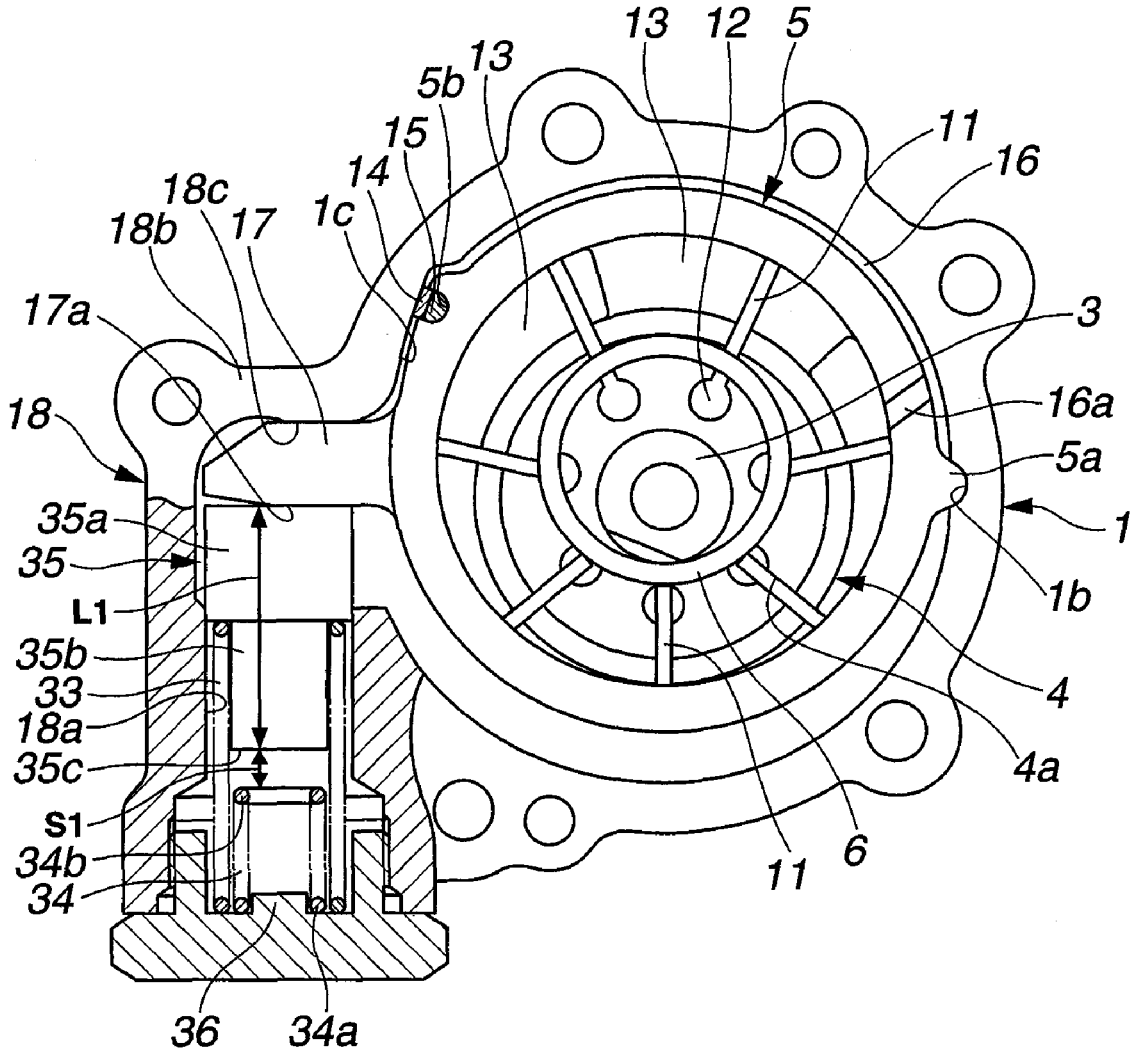
FIG. 17 is a partially sectional front view showing a variable displacement pump according to a fourth embodiment of the present invention.
Figure 18:
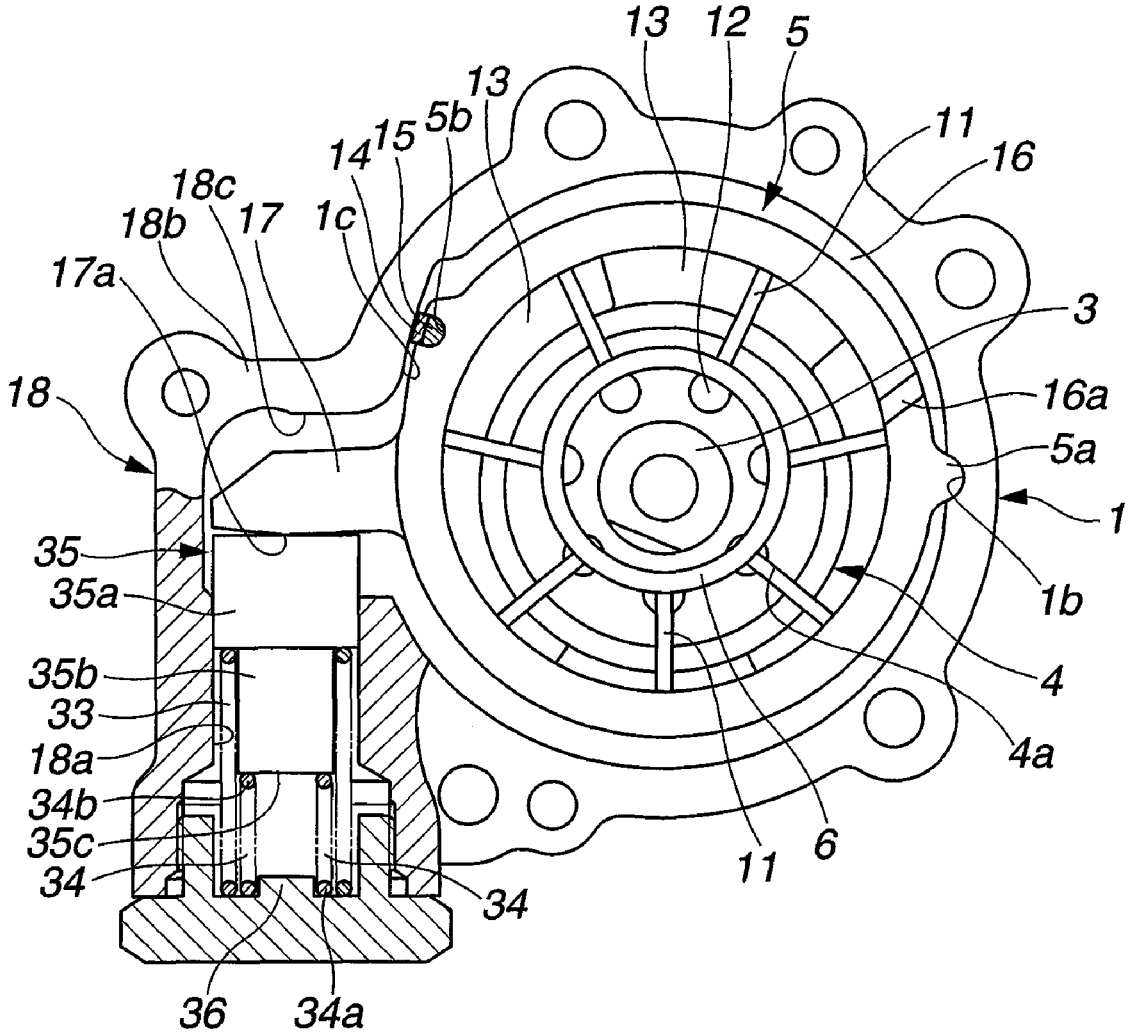
FIG. 18 is an illustrative view showing an operation of the variable displacement pump of FIG. 17.
Figure 19:
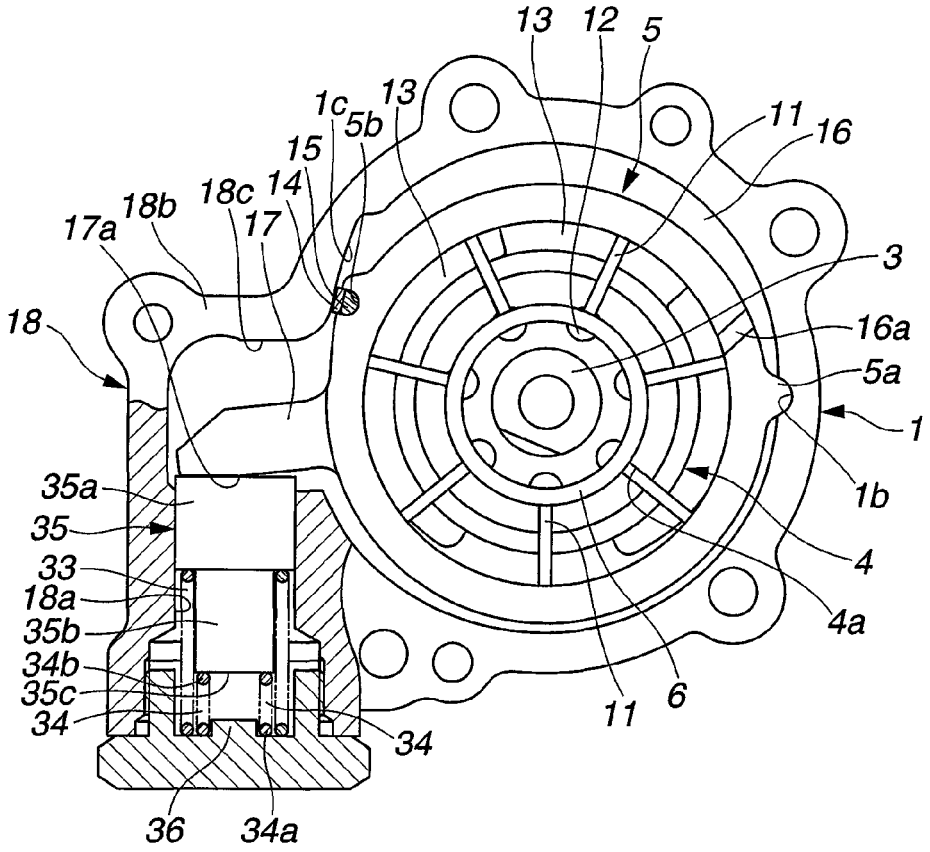
FIG. 19 is an illustrative view showing the operation of the variable displacement pump of FIG. 17.

FIGS. 17~19 shows a variable displacement pump according to a fourth embodiment of the present invention. The structure of the urging section in this embodiment is different from the structure in the other embodiments. The variable displacement pump includes a first coil spring 33 with a larger diameter; a second coil spring 34 with a smaller diameter which is disposed radially inside first coil spring 33 in parallel with first coil spring 33; a plunger 35 having a larger diameter portion 35*a* on the upper side and a smaller diameter portion 35*b* on the lower side. The upper end portion of first coil spring 33 is abutted on the outer circumference portion of the lower surface larger diameter portion 35*a* of plunger 35, like the third embodiment. The lower end portion of first coil spring 33 is abutted on the upper surface of plug cover portion 19*a*.

Second coil spring 34 includes a lower end portion abutted on the upper surface of plug cover portion 19*a*, and an upper end portion disposed freely. When plunger 35 is moved downwards by the predetermined distance, the upper end portion of second coil spring 34 is abutted on the lower surface 35*c* of plunger 35.

That is, plunger 35 includes large diameter portion 35*a* having a cylindrical shape, and located on the upper side; and small diameter portion 35*b* having a cylindrical shape, and formed at a central portion of the lower surface of large diameter portion 35*a*. The upper end portion of first coil spring 33 is abutted on the lower outer circumference surface of large diameter portion 35*a*. The inner circumference of the upper end portion of first coil spring 33 is slidably held by the outer circumference surface of small diameter portion 35*b*. Overall axial length of large diameter portion 35*a* and small diameter portion 35*b* is set to predetermined length L1.

Second coil spring 34 includes a lower end portion 34*a* having an inner circumference fit, by press fitting, on an outer circumference of protruding portion 36 protruding in the upward direction at the central portion of plug cover portion 19*a*. In the maximum eccentric state of cam ring 5 shown in FIG. 17, second coil spring 34 is in the free length state in which upper end portion 34*b* is apart from the lower surface of smaller diameter portion 35*b* by the predetermined length S.

Spring set load W1 of first coil spring 33 is set in the same manner as the first embodiment. However, the second coils spring 34 does not have the spring load. Moreover, the springs are wound in the opposite directions.

Figure 20:
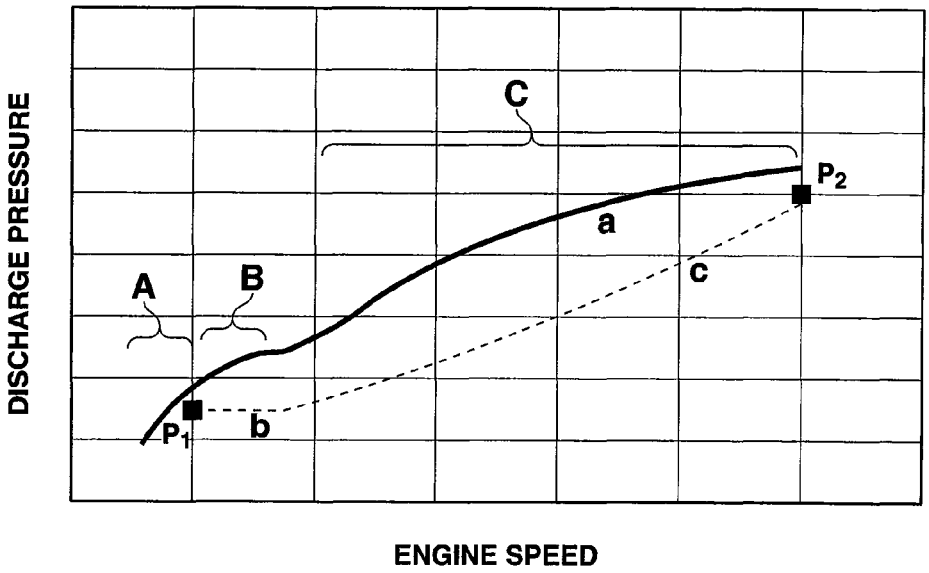
FIG. 20 is a characteristic view showing a relationship between a discharge hydraulic pressure and an engine speed in the variable displacement pump of FIG. 17.
Figure 21:
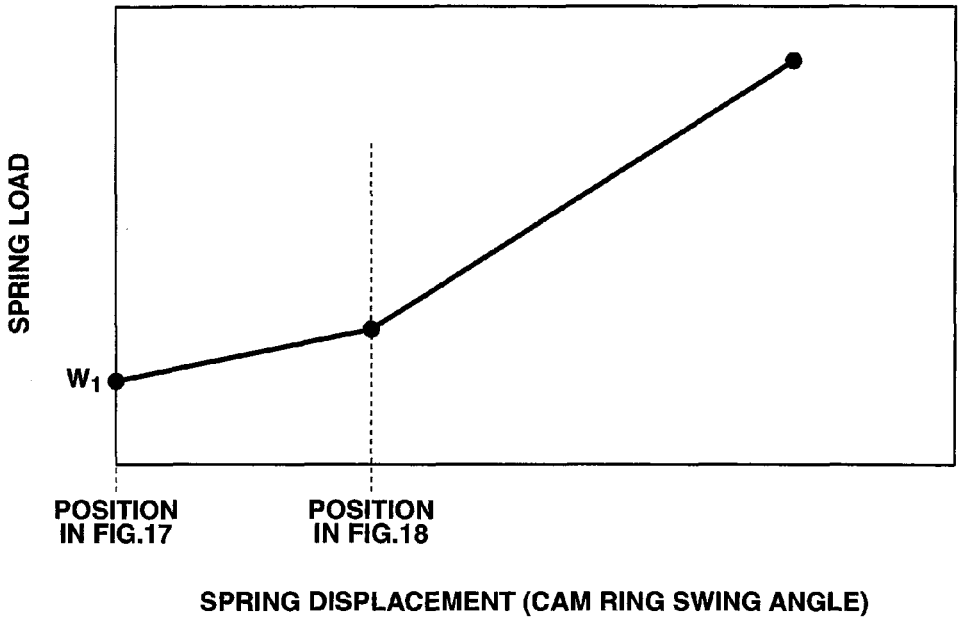
FIG. 21 is a characteristic view showing a relationship between displacements of first and second coil springs and a spring set load.

FIG. 20 shows a characteristic of the discharge pressure in the variable displacement pump according to the fourth embodiment of the present invention.

That is, when the discharge pressure increases to P1 of FIG. 20 as the engine speed increases. In this case, the hydraulic pressure introduced into hydraulic control chamber 16 increases, and cam ring 5 compresses and varies first coil spring 33 acted to arm 17, and is pivoted about pivot portion 5*a* in the counterclockwise direction in the eccentric manner. Consequently, the pump capacity decreases, so that the increasing characteristic of the discharge pressure decreases as shown in region B of FIG. 20. Then, the outer circumference portion of the lower surface of smaller diameter portion 35*b* of plunger 35 is abutted on the upper surface of second coil spring 34 as shown in FIG. 18. However, second coil spring 34 does not have the spring set load, and accordingly the spring constant increases for the two coil springs. When the engine speed further increases, cam ring 5 is swung by the increase of the hydraulic pressure. For the increase of the spring constant, cam ring 5 is hard to swing relative to region B of FIG. 20. The hydraulic pressure increases as shown in a region C of FIG. 20, and the engine speed reaches the maximum engine speed in a state in which the increase quantity of the hydraulic pressure is slightly larger than in region B of FIG. 20.

The relationship between the displacements of each of coil springs 33 and 34 or the swing angle of cam ring 5 and the spring set load becomes a stepped increasing characteristic at a timing at which second coil spring 34 starts to be compressed after first coil spring 33 is compressed.

Accordingly, the variable displacement pump according to the fourth embodiment can attain the same effect as the variable displacement pump according to the other embodiments. Moreover, in this embodiment, second coil spring 34 is fit on protruding portion 36 in advance by press fitting, and it is possible to facilitate the assembling operation.

Fifth Embodiment

Figure 22:
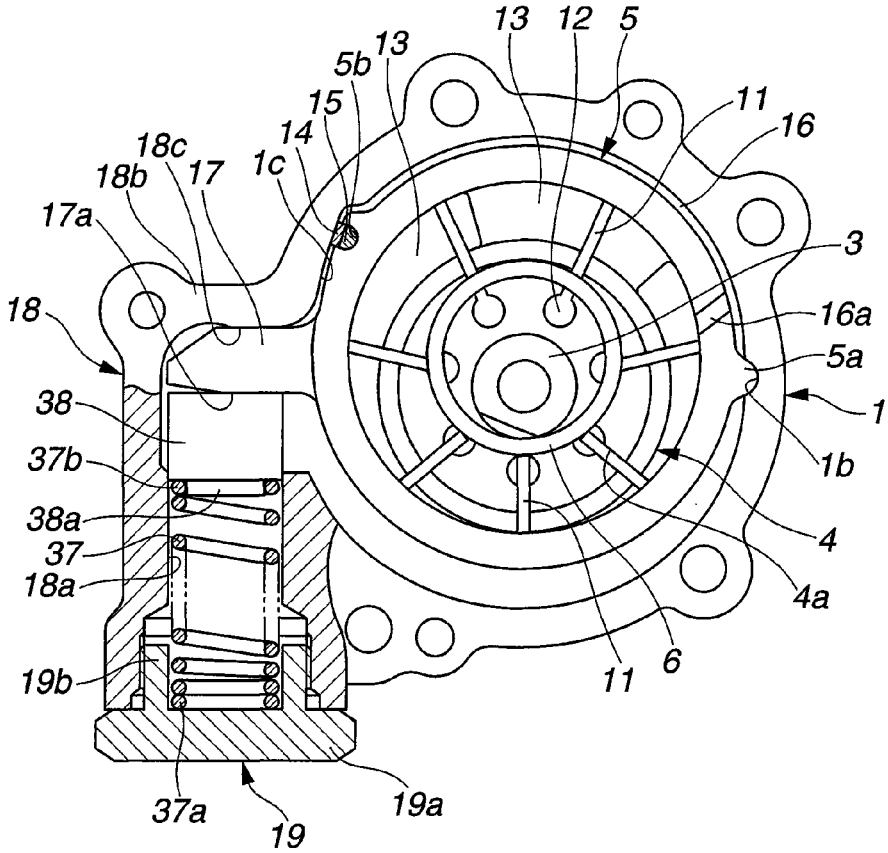
FIG. 22 is a partially sectional front view showing a variable displacement pump according to a fifth embodiment of the present invention.

FIG. 22 shows a variable displacement pump according to a fifth embodiment of the present invention. The basic structure of the fifth embodiment is identical to the structure of the other embodiments. However, in this embodiment, coil spring 37 of the urging section is formed of a single member, and plunger 38 of the urging section is formed of a single member. Coil spring 37 is formed of a variable pitch spring. Coil spring 37 has a lower end portion 37*a* abutted on the upper surface of plug cover portion 19*a*; and an upper end portion 37*b* abutted on the outer circumference portion of the lower surface of plunger 38. Coil spring 37 has a spring constant increasing with the compression of coil spring 37.

Plunger 38 is formed into a substantially cylindrical shape like the plunger of the fourth embodiment. Plunger 38 includes a protruding portion 38*a* integrally formed with plunger 38 at a central portion of the lower surface of plunger 38, and over which coil spring 37 is fit by press fit to hold coil spring 37. The other structures of this embodiment is identical to the structure of the other embodiments.

Accordingly, the operation of the fifth embodiment is basically identical to the operation of the fourth embodiment, and the characteristic of the discharge pressure is identical to the characteristic of FIG. 20.

In the case in which the discharge pressure increases to P2 of FIG. 20 as the engine speed increases, the hydraulic pressure introduced into hydraulic control chamber 16 increases. Accordingly, cam ring 5 compresses coil spring 37 acted to arm 17, and is pivoted about pivot portion 5*a* in the counterclockwise direction in the eccentric manner. Consequently, the pump capacity decreases, so that the increasing characteristic of the discharge pressure decreases as shown in region B of FIG. 20. When the engine speed further increases, cam ring 5 is swung by the increase of the hydraulic pressure. The spring constant increases with the compression of the spring, cam ring 5 is hard to swing relative to region B of FIG. 20. The hydraulic pressure increases as shown in a region C of FIG. 20, and the engine speed reaches the maximum engine speed in a state in which the increase quantity of the hydraulic pressure is slightly larger than in region B of FIG. 20.

Accordingly, the variable displacement pump according to this embodiment can attain the same effect as the variable displacement pump according to the other embodiments. In particular, coil spring 37 and plunger 38 are formed, respectively, of the single members, and accordingly it is possible to decrease the manufacturing cost relative to the other embodiments, and to sufficiently decrease the size in the radial direction.

Sixth Embodiment

Figure 23:
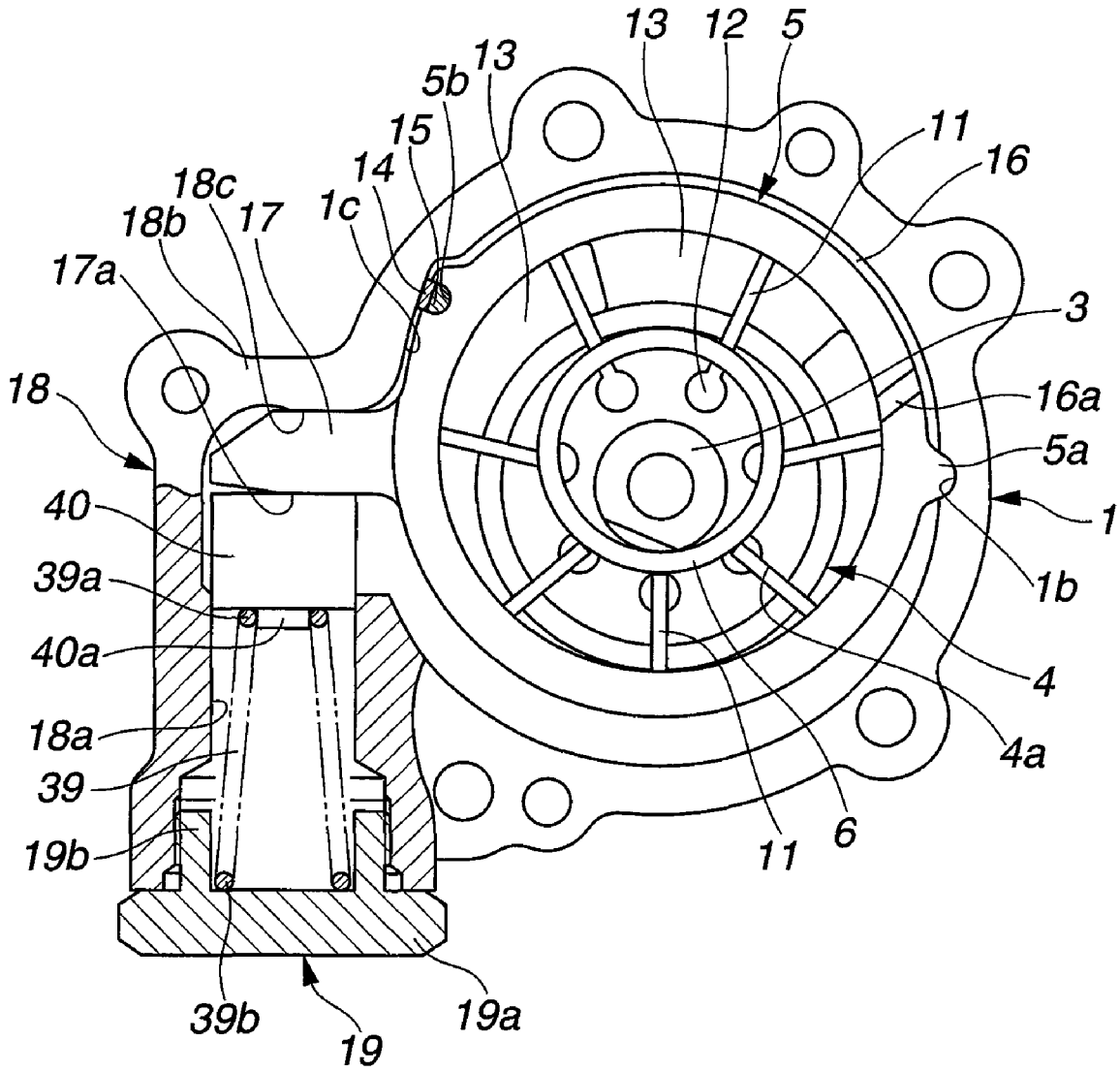
FIG. 23 is a partially sectional front view showing a variable displacement pump according to a sixth embodiment of the present invention.

FIG. 23 is a view showing a variable displacement pump according to a sixth embodiment of the present invention. The urging section includes a coil spring 39 having a tapered shape which has an upper end portion 39*a* with a small diameter, and a lower end portion 39*b* with a larger diameter, and which increases the diameter from upper end portion 39*a* to lower end portion 39*b*. This coil spring 39 is formed of a single member. Upper end portion 39*a* of coil spring 39 is abutted on the outer circumference portion of the lower surface of plunger 40, and fit, by press fit, on a protruding portion 40*a* integrally formed at a central portion of the lower surface of plunger 40. Lower end portion 39*b* of coil spring 39 is abutted on the upper surface of plug cover portion 19*a*. This coil spring 39 has a spring set load which increases as coil spring 39 are compressed for the characteristic of the tapered shape. The other structures of this embodiment is identical to the structure of the first embodiment. Accordingly, it is possible to decrease the manufacturing cost, and decrease the size in the radial direction, like the fifth embodiment.

Seventh Embodiment

Figure 24:
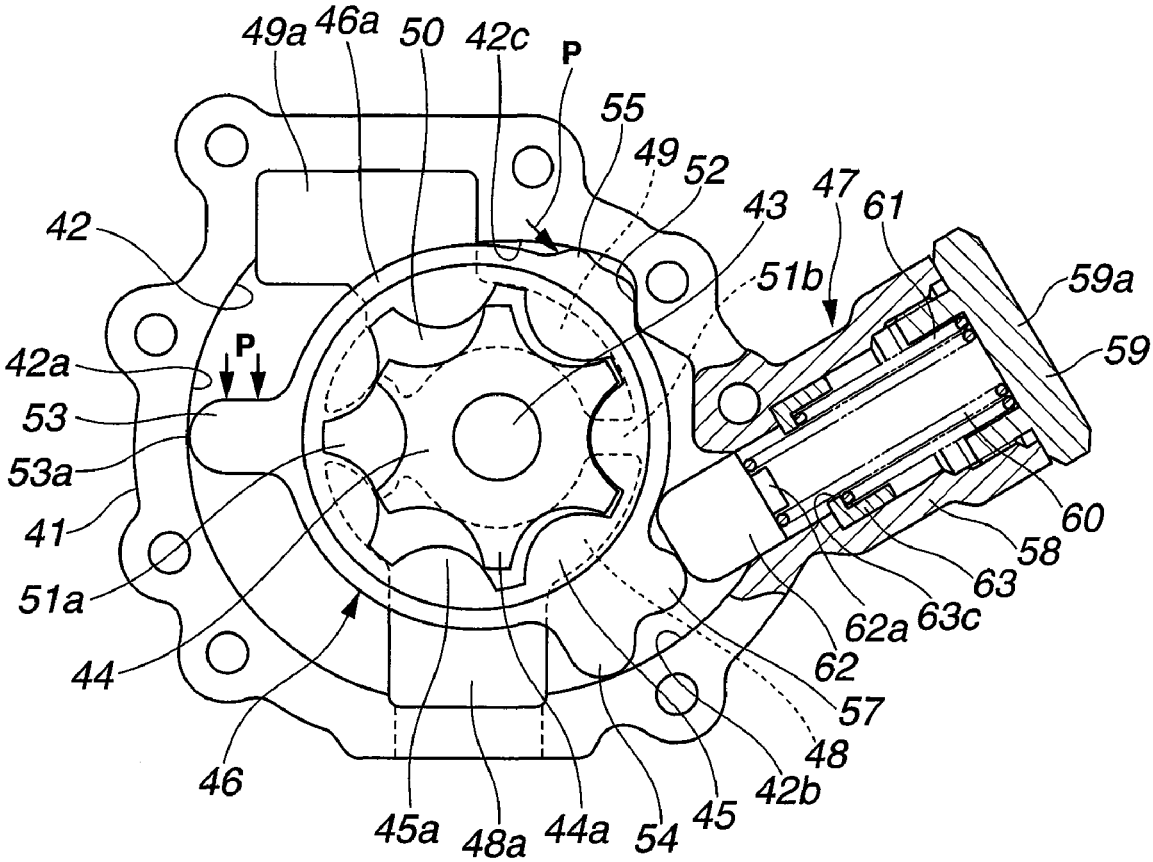
FIG. 24 is a partially sectional front view showing a variable displacement pump according to a seventh embodiment of the present invention.

FIG. 24 is a variable displacement pump according to a seventh embodiment of the present invention. In this seventh embodiment, the present invention is applied to a trochoid pump as the variable displacement pump. The urging section in this embodiment is identical to the urging section in the first embodiment. This trochoid pump includes a pump housing 41 having an opening opened in an one end of pump housing 41, and closed by a cover (not shown); a driving shaft 43 passing through a substantially central portion of pump housing 41, and receiving the torque from the crank shaft of the engine; an inner rotor 44 and an outer rotor 45 rotatably received within a receiving recessed portion 42 formed within pump housing 41; an adjusting ring 46 rotatably moved within receiving recessed portion 42, and having an inner circumference surface which rotatably slidably supports an outer circumference surface of outer rotor 45.

Pump housing 41 is integrally formed from aluminum alloy, and formed with an insertion hole located at the central portion of pump housing 41, and rotatably supporting driving shaft 43. Pump housing 41 is formed with the receiving recessed portion 42 which is located in the inside of pump housing 41, and which is in a deformed ellipse shape. At a front end portion of pump housing 41, the cover is fixed by six bolts. There is provided an adjusting mechanism 47 located on the right side of FIG. 24, and arranged to urge adjusting ring 46 in a clockwise direction.

The rotational driving force is transmitted from the crank shaft through a pulley (not shown) provided at one end portion, to driving shaft 43, and driving shaft 43 is driven in the counterclockwise direction shown by an arrow in FIG. 24.

The central portion of inner rotor 44 is connected with driving shaft 43. Inner rotor 44 includes six outer teeth 44*a* formed on the outer circumference by a trochoid curve. Outer rotor 45 has a center eccentric from the center of inner rotor 44 by a predetermined distance e. Outer rotor 45 includes seven inner teeth 45*a* formed on the inner circumference by a trochoid curve, and arranged to engage with outer teeth 44*a*. Accordingly, there is formed pump chambers 55 defined by spaces surrounded by teeth ends and teeth bottoms of inner and outer rotors 44 and 45. The volume of pump chamber 50 is varied in accordance with the rotations of inner and outer rotor 44 and 45.

At a lower position of pump housing 41 in FIG. 24, there is provided a substantially arc induction chamber 48. At an upper position of pump housing 41 in FIG. 24, there is provided discharge chamber 49. At a lower end of pump housing 41, there is provided an induction port 48*a* connected with induction chamber 48. At an upper end of pump housing 41, there is provided a discharge port 49*a* connected with discharge chamber 49. Induction port 48*a* is connected through induction passages (not shown) connected with the induction opening, to a strainer and the inside of an oil pan provided at the lower end portion of the engine body. Discharge port 49*a* is connected through the discharge passages (not shown) connected with the discharge opening, to the oil main gallery of the engine.

At portion (left side in FIG. 24) between which one end of discharge chamber 49 and one end of induction chamber 48 confront each other, and in which volume of pump chamber 50 is maximized, there is provided a first seal land portion 51*a*. At portion (right side in FIG. 24) between which the other end of discharge chamber 49 and the other end of induction chamber 48 confront each other, and in which volume of pump chamber 50 is minimized, there is provided a second seal land portion 51*b*. In this embodiment, the shape of first seal land portion 51*a* is substantially identical to the shape of pump chamber 50 of the maximum volume.

Figure 25:
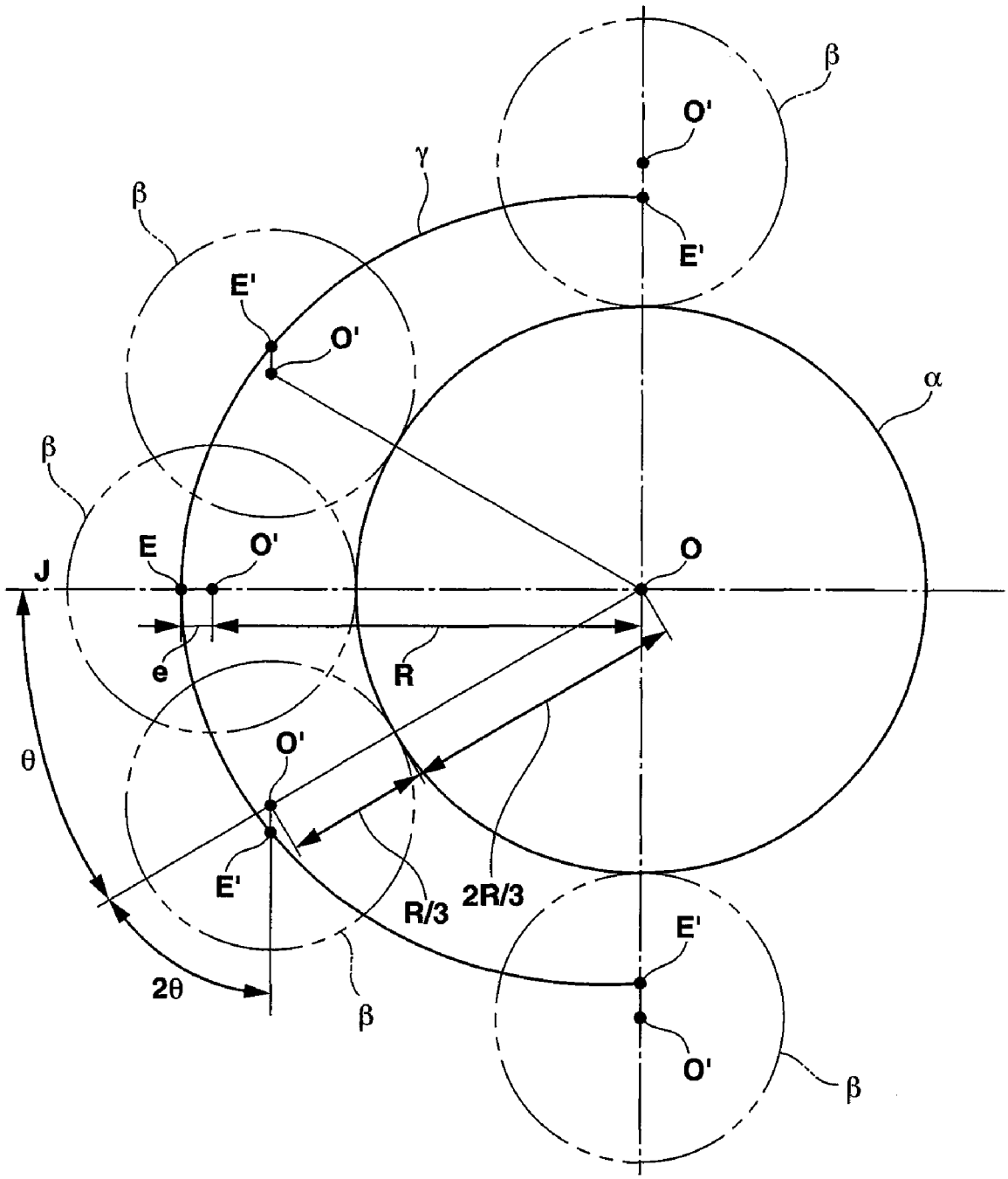
FIG. 25 is an illustrative view showing a process of forming curved portions of receiving recessed portion in the variable displacement pump of FIG. 24.

Recessed receiving portion 42 includes a first curve surface 42*a*, a second curve surface 42*b*, and a third curve surface 42*c* which are formed on the inner circumferential surface, which are arranged at intervals of 120° in the circumferential direction, and which are formed, respectively, by trochoid curves. First curve surface 42*a* is located at a circumferential position which corresponds to the maximum volume portion of pump chamber 50. Second curve surface 42*b* is located at a circumferential position which is inclined 1200 from the circumferential position of first curve surface 42*a* in the counterclockwise direction. Third curve surface 42*c* is located at a circumferential position which is inclined 1200 from the circumferential position of first curve surface 42*a* in the clockwise direction. Forming process of these first~third curve portions 42*a*~42*c* will be illustrated with reference to FIGS. 25 and 26. A radius R with arbitrary length is set from center O of inner rotor 44. Then, a base circle α with a radius 2R/3 is drawn with respect to this radius R. An imaginary rolling circle β with radius R/3 which is rotated on base circle α is set. A line connecting center O of base circle α and center O' of imaginary circle β is set to a reference line J. This reference line J is set to pass through the center of first seal land portion 51*a*. Discharge chamber 49 and discharge port 49*a* are positioned on the upper side of reference line J in FIG. 24, and induction chamber 48 and induction port 48*a* are positioned on the lower side of reference line J in FIG. 24.

A fixed point E is set on an extension of reference line J at a position which is away from center O' of imaginary circle β by eccentric quantity e of outer rotor 45 with respect to inner rotor 44 in the radial direction, in the direction opposite to the direction from center O' of imaginary circle β to center O of base circle α.

A trochoid curve γ is a curve represented by a path of fixed points E and E' when imaginary circle β rolls on base circle α without sliding.

In a case in which imaginary rolling circle β rolls on base circle α to a position of θ without sliding, rolling circle β revolves on its axis by 2θ, and consequently fixed point E rotates by 3θ with respect to reference line J.

Figure 26:
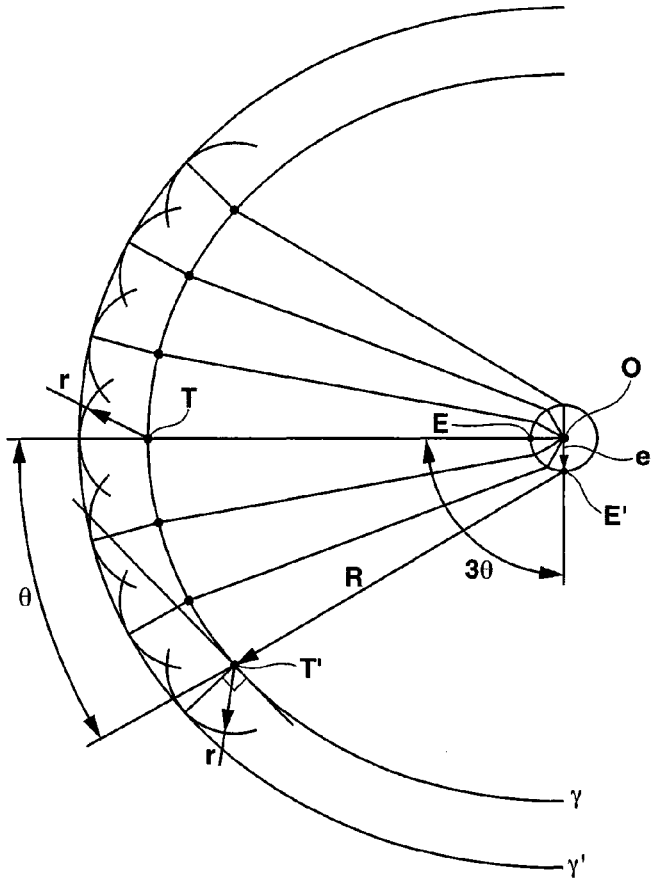
FIG. 26 is an illustrative view showing a process of forming the curved portions.

This is rewritten as shown in FIG. 26. That is, point E which is away from center O of inner rotor 44 by eccentric amount e is set. Then, a point T is set to a position which is away from point E by radius R. Reference line J connecting center O, point E, and point T in a direction from center O to point T is set. Trochoid curve γ is the path of point T' which is inclined by θ with respect to reference line J and away by distance R, from point E' to which point E is rotated about center point O by 3θ. Accordingly, when point T is rotated to point T' by angle θ, point E is rotated to point E' by angle 3θ. That is, when adjusting ring 46 is rotated by angle θ, center X of adjusting ring 46 is rotated by angle 3θ.

Each of curve portions 42*a*~42*c* of receiving recessed portion 42 is formed by a curve γ' which has the trochoid curve shape formed by circle of radius r, and having a center T' on trochoid curve γ, that is, by curve γ' which has the trochoid curve shape represented by path of point which is apart from point T' radially outwards on the normal by distance of radius r.

A stopper surface 52 is continuously formed at a position which is adjacent to curve surface portion 42*c* positioned on discharge chamber 49's side, which is on the pump rotating direction's side of curve surface portion 42*c*. Stopper surface 52 has an inverse L-shape.

Figure 27:
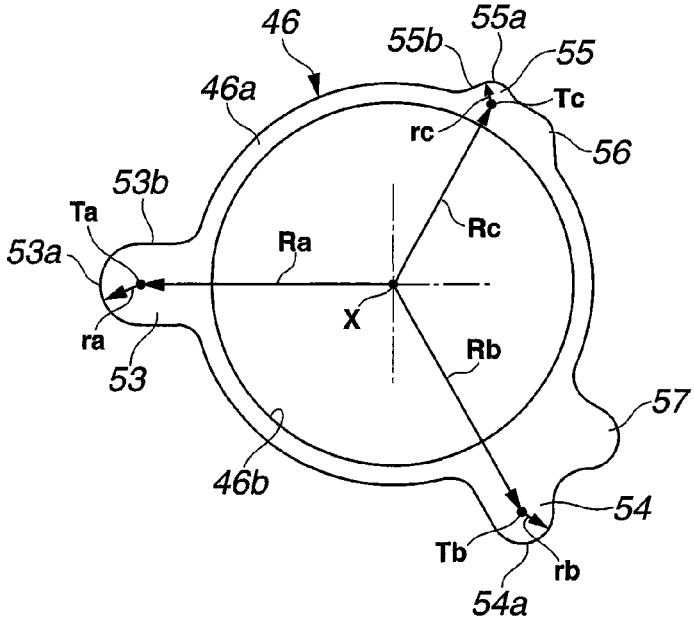
FIG. 27 is a front view showing an adjusting ring provided to the variable displacement pump of FIG. 24.

Adjusting ring 46 includes a ring body 46*a* which is formed into a substantially annular shape as shown in FIG. 27. The external surface of outer rotor 45 is slidably rotatably supported on an inner circumference surface 46*b* of ring body 46*a*. Ring body 46*a* includes three sliding portions 53~55 integrally formed on the outer circumference of ring body 46*a*, slidably abutted, respectively, on first~third curve surface portions 42*a*~42*c* of receiving recessed portion 42, as shown in FIGS. 24 and 27.

These sliding portions 53~55 are located, respectively, at positions which corresponds to first~third curve portions 42*a*~42*c*, and which are positioned apart from one another by 120° in the circumferential direction. Sliding portions 53~55 include, respectively, semicircular tip end portions 53*a*~55*a* having radiuses of r, and centers Ta~Tc which are apart from center X of inner circumferential surface 46*b* by distance R.

As shown in FIG. 27, center Ta is set at a position which is apart from center X of inner circumference surface 46*b* by radius Ra, tip end surface 53*a* of first sliding portion 53 has a semicircle shape which has center Ta and radius ra. Center Tb is set at a position which is apart from center X of inner circumference surface 46*b* by radius Rb, tip end surface 54*a* of second sliding portion 54 has a semicircle shape which has center Tb and radius rb. Center Tc is set at a position which is apart from center X of inner circumference surface 46*b* by radius Rc, tip end surface 55*a* of third sliding portion 55 has a semicircle shape which has center Tc and radius rc.

First sliding portion 53 located on the side of pump chamber 50 which has the maximum volume is formed into a maximum protruding amount having radius Ra. Second sliding portion 54 located on the induction side is formed into a middle protruding amount having radius Rb. Third sliding portion 55 located on the discharge side is formed into a minimum protruding amount having radius Rc.

Accordingly, the pressure receiving area for the pump hydraulic pressure discharged from discharge port 49*a* is larger in one end surface 53*b* of first sliding portion 53 than in one end surface 55*b* of third sliding portion 55.

Ring body 46*a* includes a regulating protrusion 56 integrally formed on ring body 46*a* at a position adjacent to third sliding portion 55 in the rotation direction, and having a side surface arranged to abut on stopper surface 52 of pump housing 41 when adjusting ring 46 rotates in the clockwise direction in FIG. 24, and thereby to limit the further rotation of adjusting ring 46.

The range of first curve surface portion 42*a* of receiving recessed portion 42 in the circumferential direction is set to a predetermined angle ($\theta-\theta1$, $\theta+\theta2$) in the both directions from a position of $\theta=0°$ by using e, Ra, and ra. The range of second curve surface portion 42*b* in the circumferential direction is set to a predetermined angle in the both directions from a position which is rotated by $\theta=120°$ in the counterclockwise direction, by using e, Rb, and rb. The range of third curve surface portion 42*c* in the circumferential direction is set to a predetermined angle in the both directions from a position which is rotated by $\theta=-120°$ by using e, Rc, and rc.

Consequently, tip end surfaces 53*a*~55*a* of sliding portions 53~55 can be slid on curve surface portions 42*a*~42*c* with minute clearances.

Moreover, adjusting ring 46 includes a circular abutment portion 57 integrally formed with adjusting ring at a position which is adjacent to second sliding portion 54, and which is on the rotational direction side's of adjusting ring 46, abutted on a plunger described later, and arranged to rotate adjusting ring 46 in the counterclockwise direction.

As shown in FIG. 24, adjusting mechanism 47 includes a cylindrical cylinder body 58 protruding from a side portion of pump housing 41 in the inclined manner; a plug 59 closing an opening end portion of cylinder body 58; a first coil spring 60 disposed within cylinder body 58; a second coil spring 61 disposed within cylinder body 58, positioned radially outside first coil spring 60 in a parallel manner; a first plunger 62 disposed between the end portion of first coil spring 61 and abutment portion 57 of adjusting ring 46; and a second plunger 63 which is disposed on the end portion of second coil spring 61, and which is an abutment member slidably moved on the inner circumference surface of cylinder body 58.

Cylinder body 58, plug 59, first coil spring 60, second coil spring 61, first plunger 62 and second plunger 63 are identical in structure to the first embodiment. Accordingly, the detailed illustration is omitted, and the main structure will be illustrated.

First coil spring 60 is set to predetermined spring load W1. This predetermined spring load W1 is a load at which adjusting ring 46 is pivoted in the counterclockwise direction in FIG. 24 when the hydraulic pressure is a necessary hydraulic pressure of the variable valve actuating device.

First plunger 62 is formed into a solid cylindrical shape. First plunger 62 includes a flat upper surface constantly abutted on abutment surface 57; and a lower surface formed at a central portion integrally with a protruding portion 62*a* fit in the end portion of first coil spring 60.

Second coil spring 61 includes a rear end portion abutted on cover portion 59*a*; and a front end portion abutted on an outer circumference portion of the lower surface of the upper wall of second plunger 63. Second coil spring 61 is set to predetermined spring load W2. The predetermined spring load W2 is a load at which adjusting ring 46 starts to move when the hydraulic pressure is the necessary hydraulic pressure P2 at the maximum rotation of the crank shaft.

The winding direction of first coil spring 60 is opposite to the winding direction of second coil spring 61. Accordingly, first coil spring 60 is not engaged with second coil spring 61 at the expansions and the compressions of springs 60 and 61, and it is possible to obtain smooth compression and expansion.

Second plunger 63 includes a circular upper wall having an insertion hole passing through a central portion of the upper wall; and a cylindrical portion protruding from the outer circumference of the lower surface of the upper wall of second plunger 63. First coil spring 60 is inserted through the insertion hole of the upper wall of second plunger 63. The insertion hole of the upper wall of second plunger 63 has an inside diameter sized to avoid the interference of the compression and the expansion of first coil spring 61.

First sliding portion 53 of adjusting ring 46 is located on reference line J by the spring force of first coil spring 60. Center X of ring inner circumference surface 46*b* is located on reference line X. The center of outer rotor 45 is located on reference line J. That is, the eccentric direction of outer rotor 45 with respect to inner rotor 44 is angle $\theta=0°$ in the direction of reference line J. First seal land portion 51*a* is located on reference line J. Accordingly, the position of first seal land portion 51*a* corresponds to the position of maximum volume pump chamber 50, the pump discharge quantity is set to be maximum.

Figure 28:
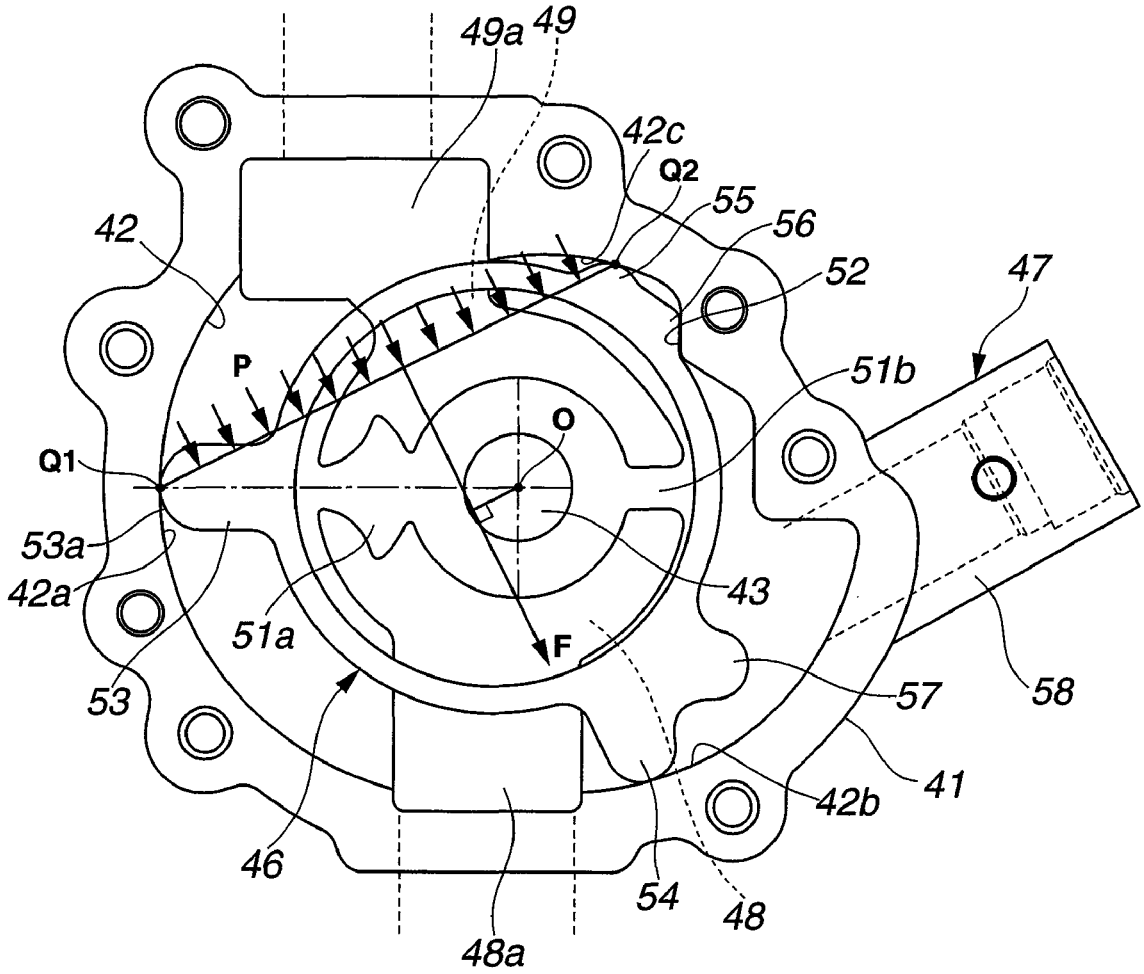
FIG. 28 is an illustrative view a hydraulic discharge pressure acted to the adjusting ring.

Hereinafter, the relationship between the pump discharge pressure and the rotation of adjusting ring 46 will be illustrated with reference to FIGS. 24 and 28.

The space between an abutment point Q1 between tip end surface 53*a* of first sliding portion 53 and first curve portion 42*a* of receiving recessed portion 42 and an abutment point Q2 between tip end surface 55*a* of third sliding portion 55 and third curve portion 42*c* of receiving recessed portion 42 is connected with discharge port 49*a*. Accordingly, the pump discharge pressure is acted to the outer circumference portion on the upper side of adjusting ring 46 located in this space. This pump discharge pressure becomes surface pressure P (arrow) acted vertically to the line connecting abutment points Q1 and Q2, and acts as resultant force G to the central portion of abutment points Q1 and Q2. Adjusting ring 46 has center X which is identical in position to central point E of outer rotor 45, and which is eccentric by the eccentric quantity e with respect to center O of inner rotor 4. Accordingly, resultant force F rotates adjusting ring 46 in the counterclockwise direction with respect to center O of inner rotor 44.

In this case, the length (Ra+ra) of first sliding portion 53 of adjusting ring 46 is longer than the length (Rc+rc) of third sliding portion 55 of adjusting ring 46 ((Ra+ra)>(Rc+rc)). The position in which the resultant force F acts is apart from center O of inner rotor 44, and the large torque in the counterclockwise direction is provided to adjusting ring 46. Moreover, the pressure receiving area of one side surface 53*b* of first sliding portion 53 is larger than the pressure receiving area of one side surface 55*b* of third sliding portion 55, as shown in FIG. 24. Consequently, the torque of adjusting ring 46 in the counterclockwise direction becomes large.

In this way, the radiuses (R+r) of three sliding portions 53~55 are different from one another, and accordingly it is possible to control the torque generated by the pump discharge pressure acted to adjusting ring 46.

Next, the operation at the engine driving (pump driving) will be illustrated.

After the start of the engine (after the start of the pump), inner rotor 44 and outer rotor 45 rotate with the rotation of driving shaft 43 so that the inner teeth 44*a* and the outer teeth 45*a* are engaged with each other. Pump chamber 50 expands on the induction chamber 48's side, and then constricts on the discharge chamber 49's side after passing through first seal land portion 51. In this way, the volume is varied, so that the pump operation is performed.

In a case in which the pump discharge pressure is zero or extremely low before the pump start or immediately after the pump start, first plunger 62 presses and urges abutment portion 57 by the spring force of first coli spring 60 of adjusting mechanism 47, adjusting ring 46 is urged in the clockwise direction. In this state, restricting protruding portion 56 is abutted on stopper surface 52, and adjusting ring 46 is limited to further rotate in the clockwise direction.

In this state, the eccentric direction of outer rotor 45 with respect to inner rotor 44 through adjusting ring 46 is the direction of reference line J, and corresponds to first seal land portion 51*a*. Accordingly, pump chamber 50 passes through first seal land portion 51*a* from induction chamber 48's side to the discharge chamber 49's side in the maximum volume of pump chamber 50. On the other hand, pump chamber 50 passes through second seal land portion 51*b* from the discharge chamber 49's side to the induction chamber 48's side in the minimum volume of pump chamber 50, so that the pump discharge quantity is maximum. Therefore, at the pump low rotational speed, the pump discharge pressure has a sudden rising characteristic shown in A of FIG. 7.

Figure 29:
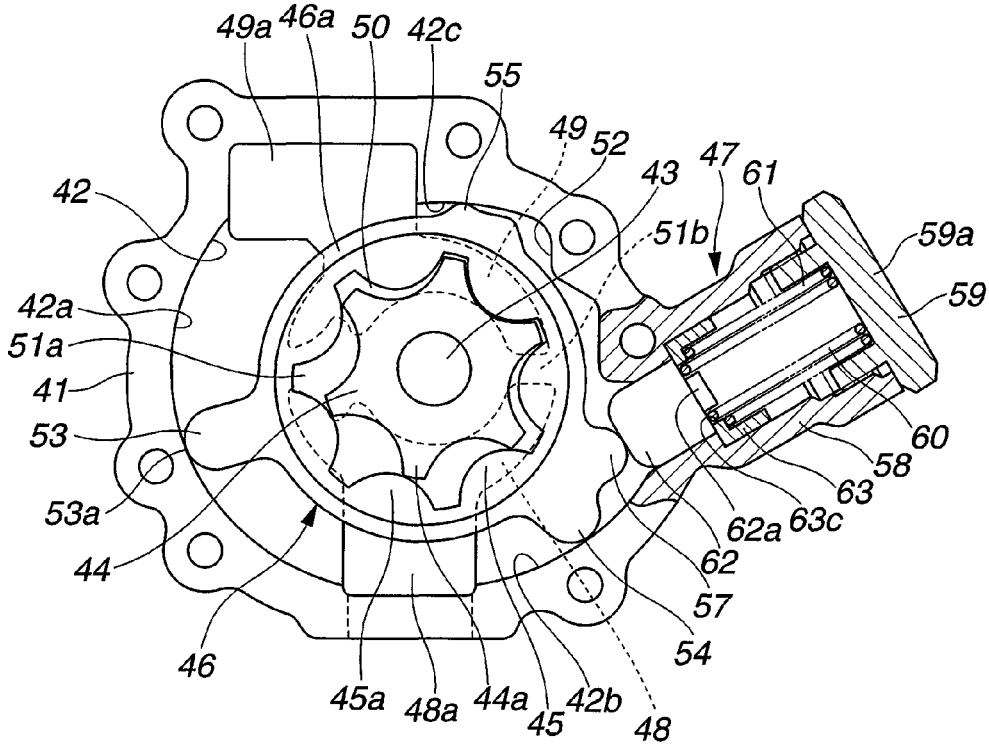
FIG. 29 is an illustrative view showing an operation of the variable displacement pump of FIG. 24.

Then, when the pump discharge pressure increases as the pump rotational speed increases, the pump discharge pressure acts from discharge port 49*a* to adjusting ring 46. Adjusting ring 46 is away from stopper surface 52 as shown in FIG. 29, and rotated against the spring force of first coil spring 60 in the counterclockwise direction by angle of substantially 15°. When first coil spring 60 is compressed and first plunger 62 is abutted on second plunger 63, spring load W2 of second coil spring 61 is acted to adjusting ring 46, and the rotation of adjusting ring 46 is stopped at a position at which the pump discharge pressure and spring load W2 are balanced.

When adjusting ring 46 is rotated by angle θ, center point X of inner circumference surface 46*a*, that is, center point E of outer rotor 45 is rotated by angle 3θ about center point O of inner rotor 44 as described above. In this state, the eccentric direction is 45°. Therefore, the volume of pump chamber 50 passing through first seal land portion 51*a* is slightly decreased, and the volume of pump chamber 50 passing through second seal land portion 50 is slightly increased. Accordingly, the oil quantity from the induction chamber 48's side to the discharge chamber 49's side are decreased. That is, the pump discharge quantity is decreased, the pump discharge quantity is gently risen to restrict the sudden rising, as shown by B~C of FIG. 7.

Adjusting ring 46 has sliding portions 53~55 having tip end surfaces 53*a*~55*a* with circular surfaces, and accordingly adjusting ring 46 smoothly slidably rotates with respect to curve portions 42*a*~42*c*.

Figure 30:
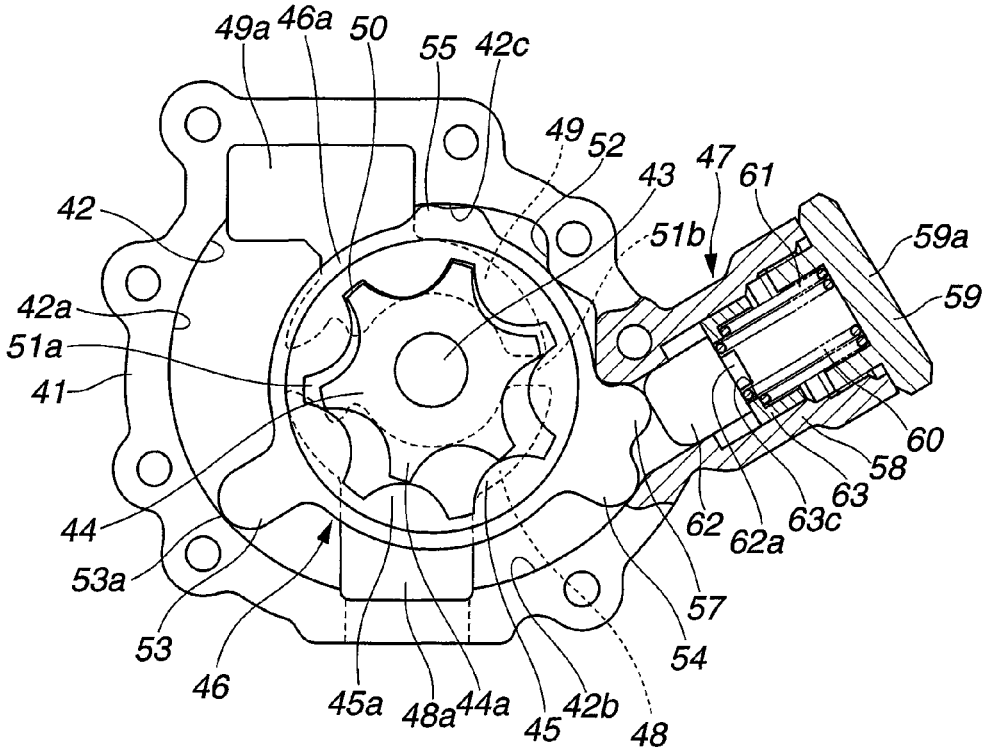
FIG. 30 is an illustrative view showing an operation of the variable displacement pump of FIG. 24.

When the rotational speed of the pump further increases, the pump discharge pressure acted to adjusting ring 46 further increases. Adjusting ring 46 is rotated in the counterclockwise direction against set load W1 and W2 of first and second coil springs 60 and 61, to the angle of 30°, as shown in FIG. 30. Accordingly, center point E of outer rotor 45 is moved by angle of 90°, and the eccentric direction of outer rotor 45 with respect to inner rotor 44 becomes substantially 90° angle position. Therefore, the volume of pump chamber 50 when pump chamber 50 passes through first seal land portion 51*a* from induction chamber 48 to discharge chamber 49 is substantially identical to the volume of pump chamber 50 when pump chamber 50 passes through second seal land portion 51*b* from discharge chamber 49 to induction chamber 48, so that the pump discharge amount becomes minimum.

In this way, adjusting ring 46 is rotated by the pump discharge pressure, the eccentric direction between inner rotor 44 and outer rotor 45 is variable with respect to pump housing 41, and it is possible to vary the pump discharge amount, and to cut the unnecessary fluid work. Accordingly, it is possible to attain the decrease of the power loss as shown in FIG. 7, like the first~third embodiments.

Adjusting ring 46 is rotated against the spring forces of coil springs 60 and 61 of adjusting mechanism 47 in accordance with the pump discharge pressure. Accordingly, it is possible to decrease the pump capacity when the discharge pressure exceeds the predetermined discharge pressure, and to sufficiently suppress the increase of the friction by the useless increase of the hydraulic pressure.

Three sliding portions 53~55 are provided on the outer circumference of adjusting ring 46 at regular intervals of 120° intervals in the circumference direction. Adjusting ring 46 is slidably rotated and abutted on curve surface portions 42*a*~42*c* of pump housing 41. Accordingly, it is possible to stabilize the rotation.

Moreover, there is the difference between the pressure receiving areas of first sliding portion 53 and third sliding portion 55 in the rotation direction of adjusting ring 46. Accordingly, it is possible to efficiently convert the pump discharge pressure by the free magnification to the torque of adjusting ring 46. Therefore, it is possible to freely set spring loads W1 and W2 of coil springs 60 and 61 of adjusting mechanism 47.

It is possible to form low frictional material on the surfaces of curve surface portions 42*a*~42*c* and tip end surfaces 53*a*~55*a*. Thereby, it is possible to improve the seal characteristic, and to obtain the further smooth rotation of adjusting ring 46.

Eighth Embodiment

Figure 31:
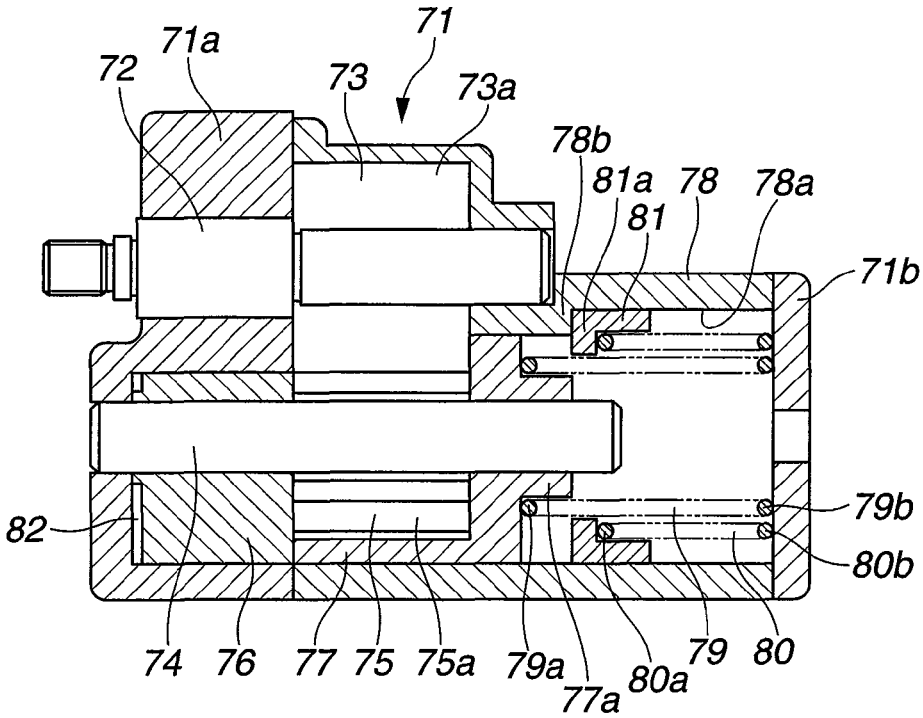
FIG. 31 is a longitudinal sectional view showing a variable displacement pump according to an eighth embodiment.

FIG. 31 is a variable displacement pump according to an eighth embodiment of the present invention. In the eighth embodiment, the present invention is applied to an external gear pump as the variable displacement pump. The basic structure of the urging section in this embodiment is substantially identical to the structure in each embodiment. The basic structure of the external gear pump has the general structure. The variable displacement pump includes a pump housing 71 having two end openings closed respectively by covers 71*a* and 71*b*; a driving shaft 72 passing through an upper end portion of pump housing 71 in the axial direction, and rotatably driven by the crank shaft of the engine; a drive gear 73 rotatably received within pump housing 71, and connected with driving shaft 72; and a driven gear 75 rotatably received in pump housing 71 through a supporting shaft 74 in a lower position of pump housing 71.

Drive gear 73 includes a plurality of teeth portions 73*a* formed on the outer circumference of drive gear 73. Drive gear 73 is restricted to move in the axial direction.

Driven gear 75 includes a plurality of teeth portions 75*a* formed on the outer circumference of driven gear 75, and arranged to be engaged with teeth portions 73*a* of drive gear 73. The pump inhales and discharges the hydraulic fluid by the rotations of teeth portions 73*a* and 75*a*. This driven gear 75 is arranged to slide in the forward and rearward directions (right and left sides in FIG. 31) through a pressure receiving member 76 connected with the front end portion of supporting shaft 74 and a first plunger 77 connected with the rear end portion of supporting shaft 74. Driven gear 75 is arranged to slidably move in the rightward direction in FIG. 31 by the pump discharge pressure supplied to hydraulic control chamber 82 formed between front cover 71*a* and the front end surface of pressure receiving member 76. The pump discharge quantity is varied in accordance with this sliding position, that is the engagement width between teeth portions 73*a* and 75*a*. At the rear side of driven gear 75, there is provided an urging section arranged to attain the maximum discharge quantity (the maximum discharge pressure) by urging driven gear 75 to a maximum front position.

This urging section includes a cylinder body 78 integrally formed with pump housing 71 made from aluminum alloy, and having a rear opening closed by rear cover 71*b*; a first coil spring 79 disposed within cylinder body 78; a second coil spring 80 disposed within cylinder body 78, surrounding first coil spring 79 in parallel with first coil spring 79; a first plunger 77; and a second plunger 81 disposed on the tip end portion side of second coil spring 80, and arranged to slidably move on inner circumference surface 78*a* of cylinder body 78.

First coil spring 79 has a coil diameter which is smaller than second coil spring 80. First coil spring 79 is disposed radially inside second coil spring 80. First coil spring 79 has an axial length longer than second coil spring 80. First coil spring 79 includes a front end portion 79*a* abutted on the rear end surface of first plunger 77, and the other end portion 79*b* abutted on the inner surface of rear cover 71*b*. First coil spring 79 is set to spring load W1. This spring load W1 is a load at which driven gear 75 starts to move in the rightward direction in FIG. 31 when the hydraulic pressure is the necessary hydraulic pressure P1 of the variable valve actuating device.

First coil spring 79 includes a front end portion 79*a* fit over, by press fit, a cylindrical protruding portion 77*a* provided integrally at the central portion on the rear end surface of first plunger 77 to hold first coil spring 79.

Second coil spring 80 includes a rear end portion 80*b* abutted on the inner surface of cover 71*b*; and a front end portion 80*a* abutted on the outer circumference portion of the lower surface of the upper wall of second plunger 81. Second coil spring 80 is set to predetermined set load W2. This set load W2 is a load at which driven gear 75 starts to move when the hydraulic pressure is necessary hydraulic pressure P2 at the maximum engine speed of the crank shaft.

Second plunger 81 is slidably moved in the right and left directions on inner circumference surface 78*a* of cylinder body 78. Second plunger 81 includes an end wall 81*a* having an outer circumference surface arranged to abut on a stopper protrusion 78*b* formed at a front end portion of inner circumference surface 78*a*. Second plunger 81 is restricted to move in the leftward direction in FIG. 31 by the abutment between end wall 81*a* and stopper protrusion 78*b*.

Figure 32:
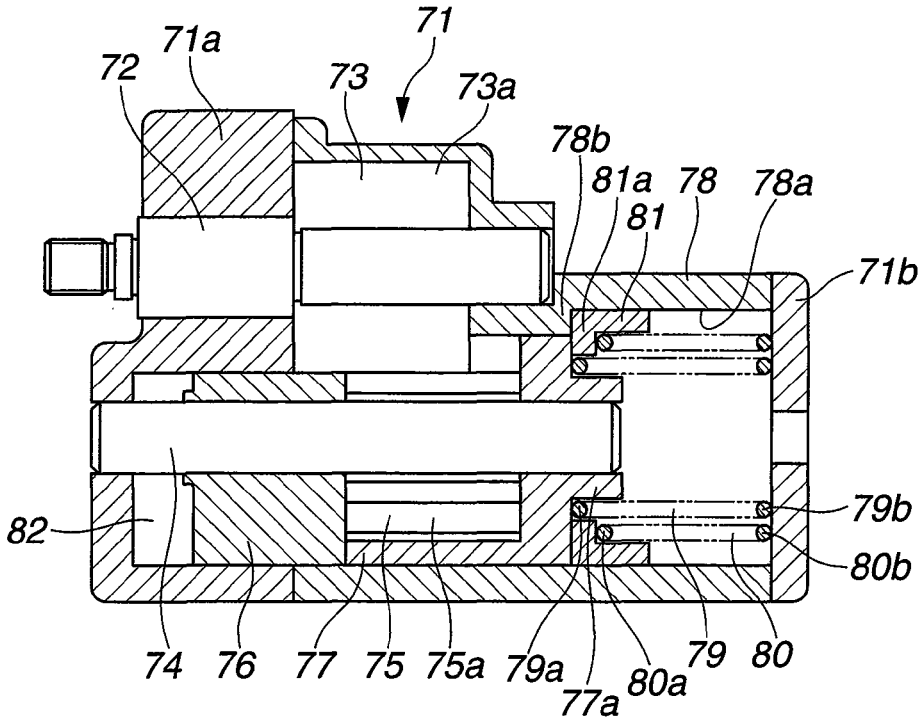
FIG. 32 is an illustrative view showing an operation of the variable displacement pump of FIG. 24.

Accordingly the operation of this embodiment is identical to the operation of each embodiment. When the discharge pressure within control hydraulic chamber 82 increases to P1 of FIG. 7 as the pump rotation (engine rotation) increases from the low rotation region, the pressure introduced into control hydraulic chamber 16 increases. Consequently, driven gear 75 starts to compress first coil spring 79, and driven gear 75 moves in the rightward direction. Accordingly, the pump capacity is decreased, and the increasing characteristic of the discharge hydraulic pressure becomes small as shown in B region of FIG. 7. As shown in FIG. 32, driven gear 75 is moved in the rightward direction until first plunger 77 is abutted on end wall 81*a* of second plunger 81.

In a state shown in FIG. 32, first plunger 77 is abutted on second plunger 81. From this time, spring load W2 of second coil spring 80 is provided in addition to spring load W1 of first coil spring 79. Driven gear 75 can not be moved in the rightward direction and held in the position until the discharge pressure reaches P2 (hydraulic pressure P2 in control hydraulic chamber 16) and the discharge pressure becomes larger than spring load W2. Accordingly, the discharge pressure has an increasing characteristic shown in C of FIG. 7 as the engine speed increases. However, the pump capacity is decreased for the small engagement width of driven gear 75. Therefore, the discharge pressure does not have a rapid increasing characteristic shown by A of FIG. 7.

Figure 33:
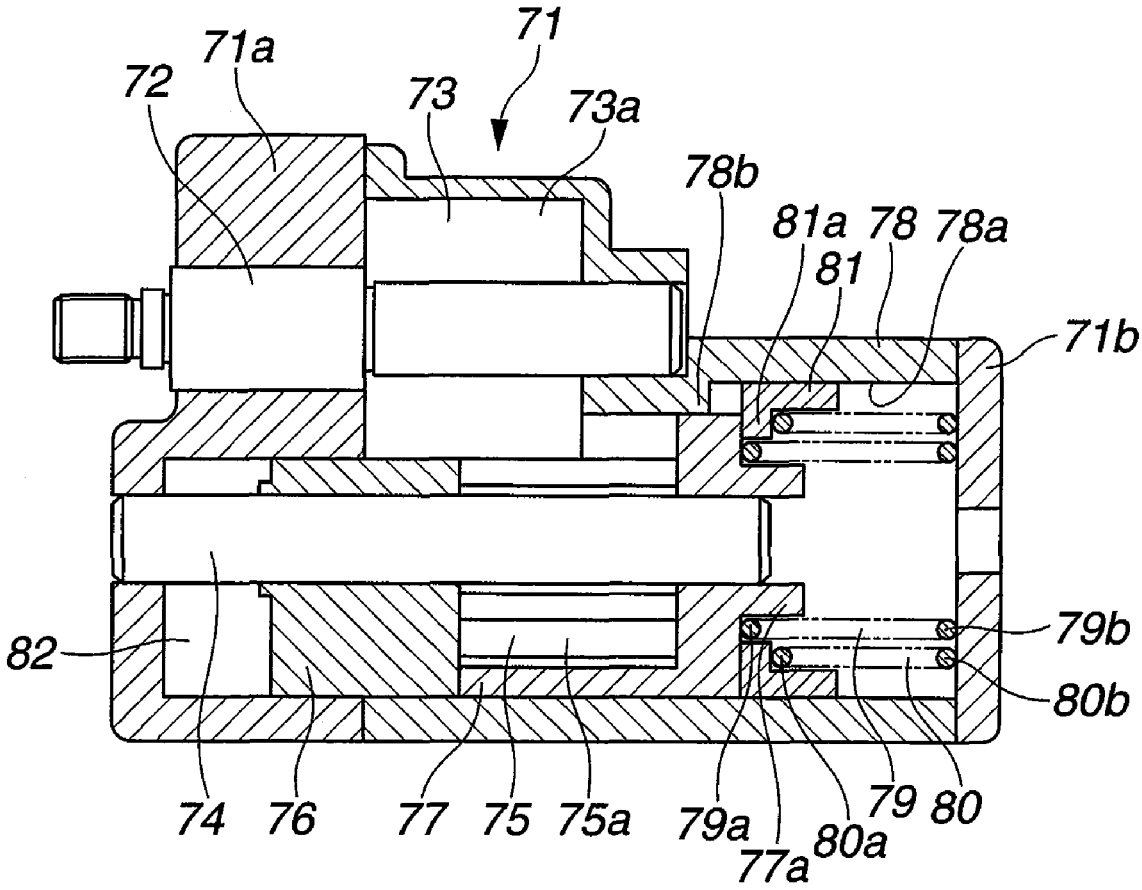
FIG. 33 is an illustrative view showing an operation of the variable displacement pump of FIG. 24.

When the engine speed further increases and the discharge pressure becomes equal to or greater than P2, driven gear 75 is moved against the spring force of set load W2 of second coil spring 80 in the rightward direction to compress first and second coil springs 79 and 80, as shown in FIG. 33. With the movement of driven gear 75, the pump capacity further decreases, and the increase of the discharge hydraulic pressure becomes small. The characteristic shown by D in FIG. 7 is held, and the engine speed reaches the maximum engine speed.

Accordingly, the characteristic of the discharge hydraulic pressure of the pump becomes the characteristic shown by A~D of FIG. 7. Therefore, it is possible to sufficiently bring the control hydraulic pressure (solid line) close to the necessary hydraulic pressure (broken line), and to sufficiently decrease the power loss by the unnecessary increase of the hydraulic pressure.

As mentioned above, in the variable displacement pump according to the embodiments of the present invention, it is possible to sufficiently decrease the power loss by the increase of the unnecessary hydraulic pressure.

In the variable displacement pump according to the first embodiment of the present invention, first and second coil springs are used. Accordingly, it is possible to arbitrarily set the spring loads of the first and second coil springs in accordance with the variation of the discharge pressure, and to set appropriate spring force for the discharge pressure.

At end portions of the coil springs, there are provided first and second plungers. Accordingly, it is possible to facilitate the assembling operation, and to move the coil spring without causing the torsion. Therefore, in the case in which the movement distance of the plunger and the swing amount are small, it is possible to abut the upper end of first coil spring directly on the lower surface of the arm.

Moreover, the arm includes the lower surface which is in the arm curved shape. Accordingly, it is possible to decrease the variation of the abutment angle and the abutment point with the upper surface of the first plunger by the swing movement of the cam ring. Therefore, it is possible to stabilize the displacement of the first coil spring.

Moreover, in a case of arranging the coil springs in series, it is possible to decrease the size of the apparatus in the radial direction.

The plunger includes a protruding portion located at the upper or lower end portion of the plunger, and over which the end portion of the coil spring is fit. Accordingly, it is possible to prevent the falling and torsion of the coil spring.

The lubricant discharged from the discharge port through the discharge opening is used as the source for actuating the valve timing control apparatus, in addition to the sliding portions of the engine. In this variable displacement pump according to the embodiment, the initial discharge hydraulic pressure becomes good state, and accordingly it is possible to improve the actuation responsiveness of the relative rotation phase between the timing sprocket and the cam shaft to the retarded angle side or the advanced angle side immediately after the start of the engine.

In the variable displacement pump according to the embodiment of the present invention, the winding direction of the first coil spring is opposite to the winding direction of the second coil spring. Accordingly, it is possible to prevent the engagement of the first and second coil springs at the compression and the expansion of the coil springs.

This application is based on a prior Japanese Patent Application No. 2007-157000. The entire contents of the Japanese Patent Application No. 2007-157000 with a filing date of Jun. 14, 2007 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump arranged to supply a lubricant to sliding portions of an internal combustion engine for a vehicle, and used as a source for actuating a variable valve actuating device arranged to control an actuation characteristic of valves of the internal combustion engine by a hydraulic pressure, the variable displacement pump comprising:

a pump section arranged to be driven by the internal combustion engine, and to discharge the lubricant introduced from an induction portion to a plurality of hydraulic chambers, through a discharge portion, by volume variations of the hydraulic chambers;

a variable mechanism arranged to move a movable member by using the discharge pressure of the lubricant, and to vary volumes of the hydraulic chambers which are opened to the discharge portion; and an urging section, which includes a first coil spring and a second coil spring and is arranged to urge the movable member in a direction to increase quantities of the volume variations of the hydraulic chambers, the urging section having a spring constant which increases as a movement distance of the movable member in a direction to decrease the quantities of the volume variations of the hydraulic chambers increases;

wherein each of the first coil spring and the second coil spring of the urging section has a spring set load in a state in which the movable member is urged by the urging section so that the volume variations of the hydraulic chambers become maximized;

wherein the first coil spring is located nearer to the movable member than the second coil spring, and the first coil spring constantly urges the movable member;

wherein the second coil spring is configured to urge the movable member when a movement distance of the movable member is at least equal to a predetermined distance; and wherein the first coil spring and the second coil spring have different lengths in a disposed state, and the first coil spring is disposed radially inside the second coil spring.

2. The variable displacement pump as claimed in claim 1, wherein the first coil spring urges the movable member through a pressing member.

3. The variable displacement pump as claimed in claim 2, wherein the second coil spring is compressed by the pressing member.

4. The variable displacement pump as claimed in claim 3, wherein the urging section includes an abutment member located on an end portion of the second coil spring which confronts the pressing member, and arranged to abut on the pressing member; and the pressing member abuts on and presses the abutment member to move the abutment member.

5. The variable displacement pump as claimed in claim 2, wherein the pressing member includes a first end surface confronting the movable member, and a second end surface opposite to the first end surface; the pressing member includes a protruding portion located on the second end surface; and one end portion of the first coil spring is mounted on and supported by the protruding portion of the pressing member.

6. The variable displacement pump as claimed in claim 1, wherein the first coil spring has a winding direction opposite to a winding direction of the second coil spring.

7. The variable displacement pump as claimed in claim 1, wherein the variable valve actuating device is a valve timing control device arranged to control a closing timing and an opening timing of the engine valves in accordance with driving conditions of the engine.

8. A variable displacement pump, arranged to supply a lubricant to sliding portions of an internal combustion engine for a vehicle, and used as a source for actuating a variable valve actuating device arranged to control an actuation characteristic of valves of the internal combustion engine by a hydraulic pressure, the variable displacement pump comprising:

a rotor which is arranged to be driven by the internal combustion engine, and which includes a plurality of slots each extending in a radially outward direction;

a plurality of vanes, each received in one of the slots of the rotor, and each slid in the radially outward direction and in a radially inward direction;

a cam ring, which receives the rotor therein, which forms a plurality of hydraulic chambers with the rotor and the plurality of the vanes, and which is arranged to swing to vary an eccentric quantity with respect to the rotor;

a restricting portion arranged to restrict a maximum eccentric quantity of the cam ring;

a first coil spring constantly urging the cam ring in a direction in which the eccentric quantity of the cam ring is maximized;

a second coil spring, which receives the first coil spring therein, which is arranged to be held in a state in which a spring set load is applied when a swing amount of the cam ring is smaller than a predetermined amount so as not to urge the cam ring, and to urge the cam ring in a direction to increase the eccentric quantity of the cam ring with respect to the rotor when the swing amount of the cam ring is equal to or greater than the predetermined amount; and a hydraulic control chamber, which is arranged to move the cam ring in a direction to decrease the eccentric quantity of the cam ring in accordance with the hydraulic pressure introduced into the control hydraulic chamber;

the rotor being arranged to rotate and thereby discharge an oil sucked into the hydraulic chambers to the sliding portions of the internal combustion engine for the vehicle, and the variable valve actuating device.

9. The variable displacement pump as claimed in claim 8, wherein the cam ring is arranged to be swung; the first coil spring presses and urges the cam ring through a pressing member abutted on the cam ring; and one of the pressing member and the cam ring includes an abutment surface between the pressing member and the cam ring, and having a curved surface.

10. The variable displacement pump as claimed in claim 9, wherein the cam ring includes an arm integrally formed with the cam ring, and protruding in a radial direction from an outer circumference surface of the cam ring; and the arm includes a surface on which the pressing member is abutted, and which is a curved shape.

11. The variable displacement pump as claimed in claim 10, wherein the hydraulic control chamber is located radially outside the cam ring, and the hydraulic control chamber receives the lubricant discharged from a discharge portion; and the hydraulic control chamber controls a movement distance of the cam ring in accordance with a relative force between the hydraulic pressure within the hydraulic control chamber and the urging force forces of the first coil spring and the second coil spring.

* * * * *